US011318509B2

(12) United States Patent
Zacary, Jr.

(10) Patent No.: US 11,318,509 B2
(45) Date of Patent: May 3, 2022

(54) DUST HOOD

(71) Applicant: Air Systems Design, Inc., Mandeville, LA (US)

(72) Inventor: Robert M. Zacary, Jr., Covington, LA (US)

(73) Assignee: Air Systems Design, Inc., Mandeville, LA (US)

( * ) Notice: Subject to any disclaimer, the term of this patent is extended or adjusted under 35 U.S.C. 154(b) by 149 days.

(21) Appl. No.: 16/181,698

(22) Filed: Nov. 6, 2018

(65) Prior Publication Data

US 2019/0137125 A1 May 9, 2019

Related U.S. Application Data

(60) Provisional application No. 62/582,041, filed on Nov. 6, 2017.

(51) Int. Cl.

| | |
|---|---|
| ***B08B 15/02*** | (2006.01) |
| ***B31B 50/80*** | (2017.01) |
| ***B08B 5/04*** | (2006.01) |
| *F24F 7/06* | (2006.01) |
| *B65H 18/08* | (2006.01) |

(52) U.S. Cl.

CPC ..... *B08B 15/02* (2013.01); *B08B 5/043* (2013.01); *B08B 5/046* (2013.01); *B31B 50/804* (2017.08); *B65H 18/08* (2013.01); *B65H 2801/84* (2013.01); *F24F 7/06* (2013.01)

(58) Field of Classification Search

CPC .... F24F 7/06; F24F 2007/001; F24F 13/0209; F24F 13/0272; B08B 15/02; B08B 15/04; B08B 5/0007; B65H 2407/51; B65H 2801/84; B65H 54/702; B65H 18/08; D21G 9/00; D21H 25/00; A47L 5/34; A47L 5/38; A47L 7/009; A47L 7/0095; A47L 9/02; A47L 9/066; A47L 9/0666; A47L 11/4058

USPC ..... 454/64–67; 15/349, 301, 309.2; 55/385.7, 385.1; 451/456; 162/53

See application file for complete search history.

(56) References Cited

U.S. PATENT DOCUMENTS 1,676,969 A * 7/1928 Henry ..... B07B 11/00 209/502
2,362,063 A * 11/1944 Fryer ..... D01D 10/0454 454/66
2,384,688 A * 9/1945 Litman ..... B24B 55/06 451/456
2,495,816 A * 1/1950 Miller ..... F24F 7/06 454/252

(Continued)

FOREIGN PATENT DOCUMENTS

CN 101664744 A * 3/2010
DE 102010063843 A1 * 6/2012 ..... F24C 15/20

(Continued)

*Primary Examiner* — Edelmira Bosques
*Assistant Examiner* — Frances F. Hamilton
(74) *Attorney, Agent, or Firm* — Kilpatrick Townsend & Stockton LLP

(57) ABSTRACT

A dust hood for a dust control system includes a first hood body and a second hood body. The first hood body and the second hood body are each selectively movable between an assembled position and a disassembled position. In the assembled position, the first hood body is adjacent to the second hood body. In the disassembled position, the first hood body is spaced apart from the second hood body.

18 Claims, 16 Drawing Sheets

(56) References Cited

U.S. PATENT DOCUMENTS 2,634,560 A * 4/1953 Ramm ..... B23Q 11/0046 451/456
2,637,600 A * 5/1953 Morton, I ..... B65G 53/42 406/152
3,096,933 A * 7/1963 Bora ..... F04D 29/646 417/247
3,272,651 A * 9/1966 Quirk ..... B08B 5/043 134/21
3,314,098 A * 4/1967 Carsey ..... B08B 15/002 15/301
3,343,197 A * 9/1967 Carsey ..... B25D 11/066 55/385.1
3,509,911 A * 5/1970 Carsey ..... B08B 15/002 137/602
3,564,990 A * 2/1971 Smedes ..... B01L 9/02 454/67
3,576,988 A * 5/1971 Henning ..... F21V 21/26 362/427
3,818,817 A * 6/1974 Nederman ..... B08B 15/002 454/65
3,838,732 A * 10/1974 Overmyer ..... B08B 15/02 164/404
3,913,470 A * 10/1975 Cullen ..... B08B 15/005 454/64
3,926,104 A * 12/1975 El Dorado ..... B08B 15/02 454/65
4,158,462 A * 6/1979 Coral ..... F16L 27/0857 285/144.1
4,177,975 A * 12/1979 Meyers ..... C21C 5/40 266/158
4,185,801 A * 1/1980 Plymoth ..... F16M 13/02 248/282.1
4,197,609 A * 4/1980 Fuhring ..... D06B 15/04 15/309.1
4,293,320 A * 10/1981 Robinson ..... B01D 46/0068 55/283
4,306,934 A * 12/1981 Seppanen ..... D21F 1/20 162/209
4,318,337 A * 3/1982 Wichmann ..... B08B 15/002 454/65
4,345,615 A * 8/1982 Di Cicco ..... B08B 3/00 134/76
4,541,327 A * 9/1985 Lundstrom ..... B08B 15/002 248/75
4,632,022 A * 12/1986 Baitinger ..... B08B 15/023 312/209
4,787,298 A * 11/1988 Hon ..... B08B 15/002 454/345
4,872,400 A * 10/1989 Brown ..... B08B 15/02 454/57
4,905,500 A * 3/1990 Mason ..... B08B 5/026 73/38
4,981,581 A * 1/1991 Didion ..... B07B 4/08 209/138
5,011,574 A * 4/1991 Gustavsson ..... D21G 3/005 15/256.51
5,052,423 A * 10/1991 Chapman ..... B08B 9/023 134/174
5,133,691 A * 7/1992 Karlsson ..... B08B 15/02 454/56
5,159,737 A * 11/1992 Kimura ..... B08B 15/002 15/314
5,167,215 A * 12/1992 Harding, Jr. ..... B23D 59/006 125/13.01
5,178,171 A * 1/1993 Chapman ..... B08B 9/023 134/122 R
5,181,294 A * 1/1993 Campbell ..... B08B 15/002 15/315
5,201,513 A * 4/1993 Mion ..... B65H 29/32 271/180
5,207,613 A * 5/1993 Ferchau ..... G06F 1/20 361/689
5,209,245 A * 5/1993 Chapman ..... B08B 9/023 134/122 R
5,217,512 A * 6/1993 Williams ..... B01D 46/0056 55/283
5,336,130 A * 8/1994 Ray ..... B08B 15/002 454/65
5,427,569 A * 6/1995 Plymoth ..... B08B 15/002 454/63
5,487,768 A * 1/1996 Zytka ..... B01D 46/0023 55/385.2
5,491,870 A * 2/1996 Holmes ..... A47L 7/009 15/301
5,496,439 A * 3/1996 Carlson ..... D21B 1/021 162/4
5,516,329 A * 5/1996 Dunn ..... B08B 15/002 454/64
5,536,206 A * 7/1996 Bodmer ..... B08B 15/04 454/65
5,560,583 A * 10/1996 Holmgren ..... B08B 15/002 248/289.11
5,594,972 A * 1/1997 Iversen ..... B08B 15/04 15/301
5,606,767 A * 3/1997 Crlenjak ..... A47L 5/38 15/301
5,738,148 A * 4/1998 Coral ..... B08B 15/002 138/107
5,820,063 A * 10/1998 Fissman ..... B65H 18/20 242/530.4
5,878,462 A * 3/1999 Linden ..... D21G 3/00 15/309.1
5,988,560 A * 11/1999 Hinz ..... B65H 18/02 242/541.7
6,017,416 A * 1/2000 Judd ..... D21C 9/06 162/60
6,035,484 A * 3/2000 Jones ..... B01D 46/0032 15/304
6,176,898 B1 * 1/2001 Courtney ..... B01D 45/12 162/272
6,357,201 B1 * 3/2002 Focke ..... B65B 55/24 53/167
6,440,265 B1 * 8/2002 Judd ..... D21C 9/06 162/60
6,503,139 B2 * 1/2003 Coral ..... B08B 15/002 285/184
6,524,180 B1 * 2/2003 Simms ..... B08B 15/002 285/184
6,565,711 B1 * 5/2003 Kleissler, Jr. ..... B08B 5/00 134/15
6,616,720 B1 * 9/2003 Smith ..... B08B 15/002 454/187
6,648,748 B1 * 11/2003 Ferlin ..... B08B 15/002 454/65
6,672,956 B1 * 1/2004 Michael ..... B08B 15/00 454/370
6,733,634 B2 * 5/2004 Van Rengen ..... D21F 2/00 162/363
6,786,264 B1 * 9/2004 Torres Martinez ..... B65H 19/1852 156/157
6,983,757 B1 * 1/2006 Becker ..... B08B 15/002 137/14
7,013,884 B2 * 3/2006 Guth ..... B23Q 11/0046 125/13.01
7,381,127 B2 * 6/2008 Price ..... B08B 15/023 141/93
8,034,192 B2 * 10/2011 Ringer ..... D21G 3/00 134/115 R
8,128,094 B2 * 3/2012 Bateman ..... F41J 13/00 273/410
8,247,738 B2 * 8/2012 Sithes ..... B23K 9/324 219/136
8,393,277 B2 * 3/2013 Johnston ..... B61B 13/00 104/229
8,469,049 B2 * 6/2013 Garceau ..... B60R 15/04 137/355.12

(56) References Cited

U.S. PATENT DOCUMENTS 8,561,623 B2 * 10/2013 Lowenstein ..... E04D 13/0765 134/104.2
8,611,087 B2 * 12/2013 Sato ..... H05K 7/20754 361/696
8,881,749 B1 * 11/2014 Smith ..... B08B 15/00 134/104.2
8,961,639 B2 * 2/2015 Sithes ..... B23K 9/324 55/385.2
9,272,367 B2 * 3/2016 Zeygerman ..... B23K 37/0235
9,434,260 B2 * 9/2016 Takahashi ..... B60L 53/18
9,656,794 B2 * 5/2017 Young ..... B65D 83/04
9,696,680 B2 * 7/2017 Kawasaki ..... G03G 15/161
9,725,852 B1 * 8/2017 Kelyman ..... D21F 7/00
9,770,684 B1 * 9/2017 Kelyman ..... B01D 46/26
10,023,996 B1 * 7/2018 Kelyman ..... D21G 9/00
10,190,259 B1 * 1/2019 Kelyman ..... D21G 9/00
10,265,741 B1 * 4/2019 Kelyman ..... D21G 9/00
10,349,797 B2 * 7/2019 Moser ..... A47L 11/4041
10,532,900 B1 * 1/2020 Stutzman ..... B65D 88/54
10,875,061 B2 * 12/2020 Vo ..... B23K 26/142
2002/0039881 A1 * 4/2002 Coral ..... F16L 27/0861 454/67
2002/0077057 A1 * 6/2002 Frink ..... F23J 11/00 454/63
2003/0172827 A1 * 9/2003 Dohner ..... B65H 35/08 101/425
2003/0196773 A1 * 10/2003 Kleissler, Jr. ..... D21G 9/00 162/199
2005/0161107 A1 * 7/2005 Turnbull ..... B28C 7/0481 141/8
2006/0086272 A1 * 4/2006 Bennet ..... B08B 15/04 101/425
2008/0060678 A1 * 3/2008 Featherston ..... B08B 15/02 134/15
2008/0257512 A1 * 10/2008 Liu ..... D21H 21/24 162/272
2009/0212184 A1 * 8/2009 Bourgeois ..... F16M 11/2014 248/288.11
2010/0037740 A1 * 2/2010 Lin ..... B23Q 11/0046 83/100
2010/0269853 A1 * 10/2010 Johnston ..... B23K 26/364 134/1.1
2012/0005846 A1 * 1/2012 Lee ..... B28B 11/22 15/4
2012/0145347 A1 * 6/2012 Ponka ..... D21G 9/0063 162/281
2013/0196585 A1 * 8/2013 Hedlund ..... F16L 27/0861 454/63
2015/0004895 A1 * 1/2015 Hammers ..... B08B 15/002 454/49
2015/0056908 A1 * 2/2015 Chapel ..... H05K 7/02 454/184
2015/0152772 A1 * 6/2015 Wikaryasz ..... F01N 13/1872 422/171
2016/0122136 A1 * 5/2016 Sardella ..... D21F 7/006 406/70
2016/0209057 A1 * 7/2016 Stolworthy ..... B01D 45/16
2016/0257519 A1 * 9/2016 Hitsman ..... B65H 19/28
2016/0326870 A1 * 11/2016 Bjorge ..... E21C 35/223
2017/0016640 A1 * 1/2017 Moon ..... B08B 15/02
2017/0073169 A1 * 3/2017 Turcotte ..... B65G 45/10
2017/0122580 A1 * 5/2017 Karamanos ..... F24F 7/04
2017/0247209 A1 * 8/2017 Oren ..... B65G 15/00
2019/0224601 A1 * 7/2019 Candutti ..... B01D 45/12
2021/0362964 A1 * 11/2021 Franchini ..... B08B 5/043

FOREIGN PATENT DOCUMENTS

EP 335522 A2 * 2/1989 ..... B41F 23/00
EP 2154440 A2 * 2/2010 ..... F24C 15/2021
EP 3336438 A1 * 6/2018 ..... F24C 15/20
JP 06018175 A * 4/1999
JP 2018103153 A * 7/2018 ..... B08B 5/00
WO WO-2004035949 A1 * 4/2004 ..... B08B 9/04

* cited by examiner

DUST HOOD

REFERENCE TO RELATED APPLICATION

This application claims the benefit of U.S. Provisional Application No. 62/582,041, filed Nov. 6, 2017 and entitled DUST HOOD, the content of which is hereby incorporated by reference in its entirety.

FIELD OF THE INVENTION

This application relates to dust hoods, and more particularly to dust hoods for tissue winders.

BACKGROUND

Tissue, towel, and paper manufacturing and converting produces a significant amount of airborne dust. If the dust reaches higher concentrations, the dust may be a nuisance to workers and equipment and present fire and health risks. To reduce such risks, dust control systems are provided to contain and remove dust to reduce the amount of airborne dust particles and thereby improve the environment for workers, prevent or reduce operation and maintenance problems (which may lead to poor sheet quality and frequent downtime for cleaning), and lower dust accumulation on surfaces. Sometimes, dust may accumulate in locations where dust hoods of the dust control systems are otherwise omitted because the worker does not have time to take the hoods off and/or move them out of the work space of the worker (e.g., where a worker needs to gain access often such as for frequent cleaning, changing parts, etc.).

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Disclosed is a dust control system including at least one dust hood. The dust hood includes a first hood body and a second hood body. In various examples, the first hood body and the second hood body are configured to selectively move between an assembled position and a disassembled position where the first hood body is connected to the second hood body in the assembled position and where the first hood body is detached from the second hood body in the disassembled position.

According to various examples, a dust hood includes a first hood body, a second hood body, and a securing device configured to selectively secure the first hood body to the second hood body such that a chamber of the first hood body is in fluid communication with a chamber of the second hood body.

According to certain examples, a method of assembling a dust hood includes rotating a first hood body about a first axis, rotating a second hood body about a second axis, and securing the first hood body to the second hood body with a securing device such that a chamber of the first hood body is in fluid communication with a chamber of the second hood body.

According to some examples, a dust hood includes a first hood body and a second hood body. The first hood body includes a first chamber of the dust hood, and the second hood body includes a second chamber of the dust hood. The first hood body and the second hood body are each selectively movable between an assembled position and a disassembled position. In the assembled position, the first hood body is adjacent to the second hood body, and, in the disassembled position, the first hood body is spaced apart from the second hood body.

According to various examples, a dust hood includes a first hood body and a second hood body. The first hood body includes a first chamber and is rotatable about a first axis, and the second hood body includes a second chamber and is rotatable about a second axis. In an assembled configuration, the first chamber is in fluid communication with the second chamber, and, in a disassembled configuration, the first chamber is fluidly disconnected from the second chamber.

According to certain examples, a dust hood includes a first end, a second end opposite from the first end, a first hood body, and a second hood body. The first hood body includes the first end of the dust hood, and the second hood body includes the second end of the dust hood. The second hood body is movable relative to the first hood body.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
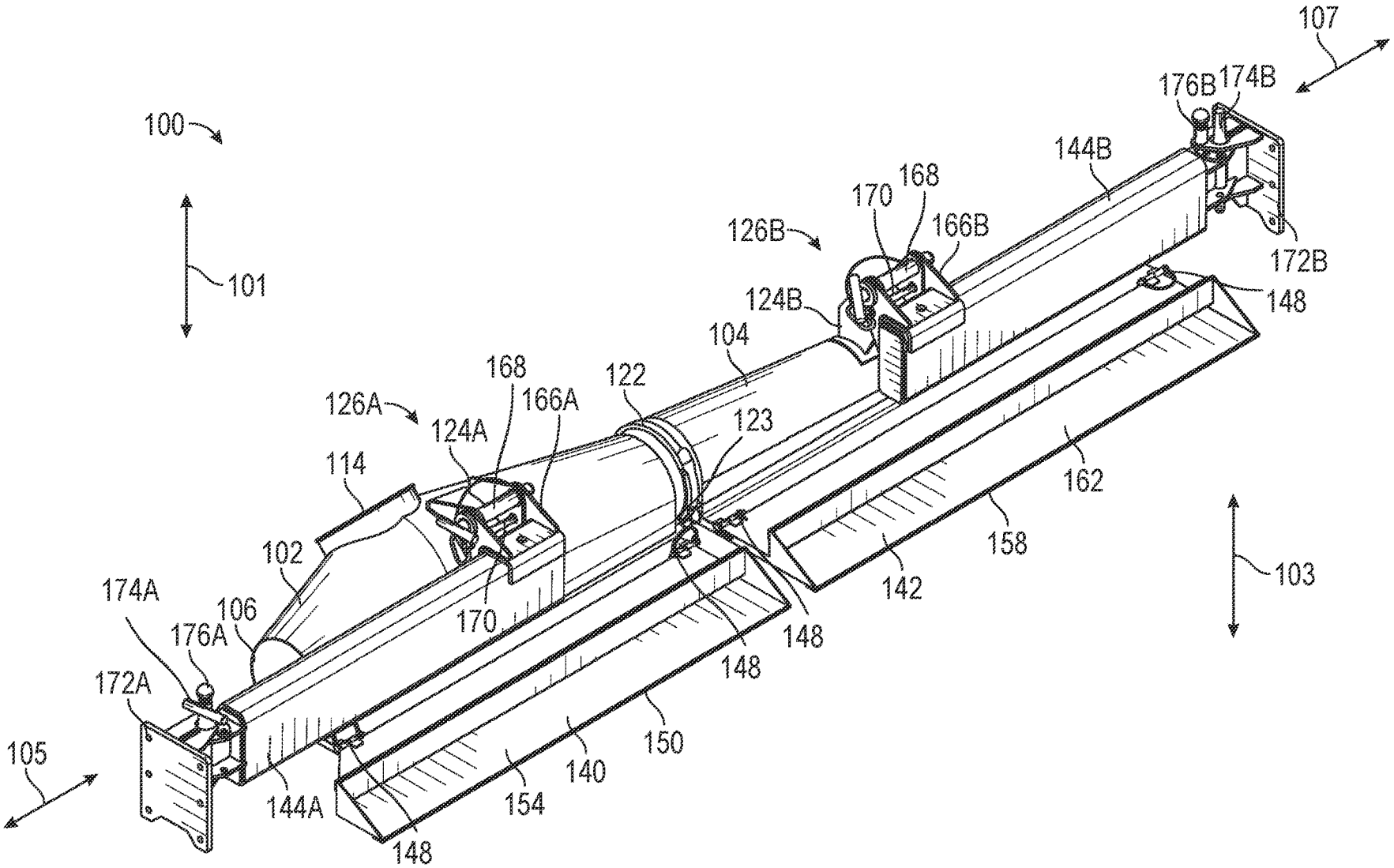
FIG. 1 is a perspective view of a dust hood according to aspects of the current disclosure.
Figure 2:
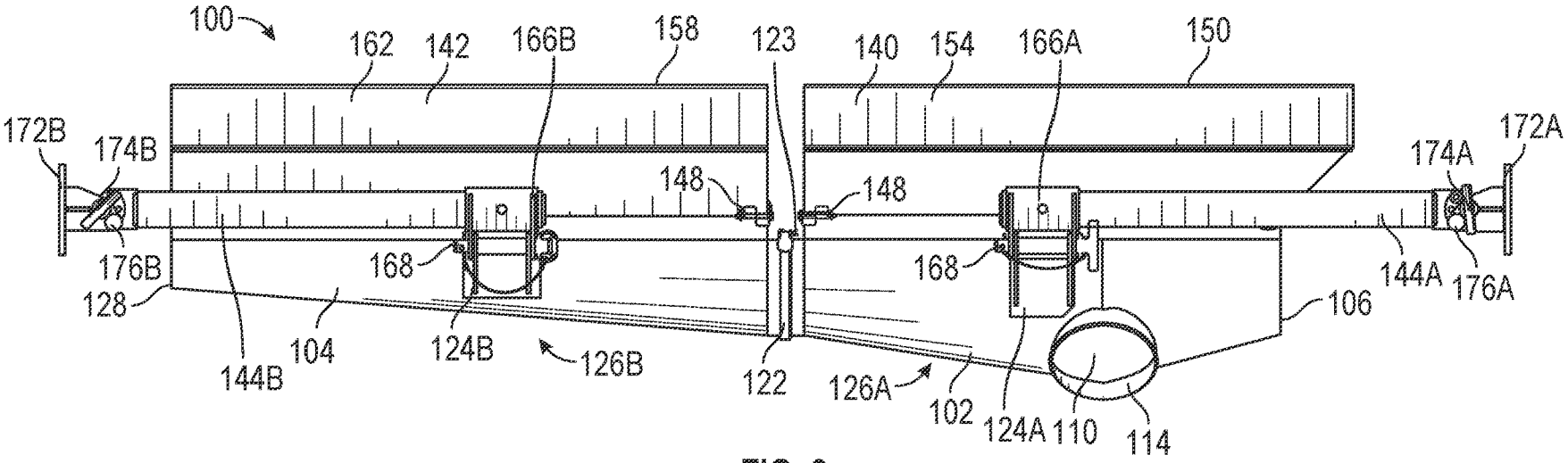
FIG. 2 is a top view of the dust hood of FIG. 1.
Figure 3:
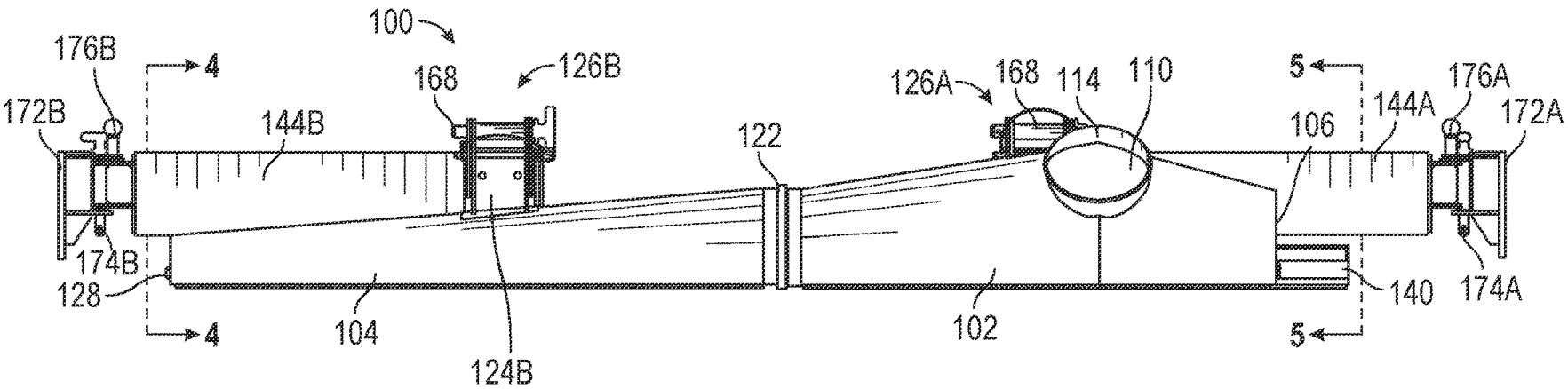
FIG. 3 is a side view of the dust hood of FIG. 1.
Figure 4:
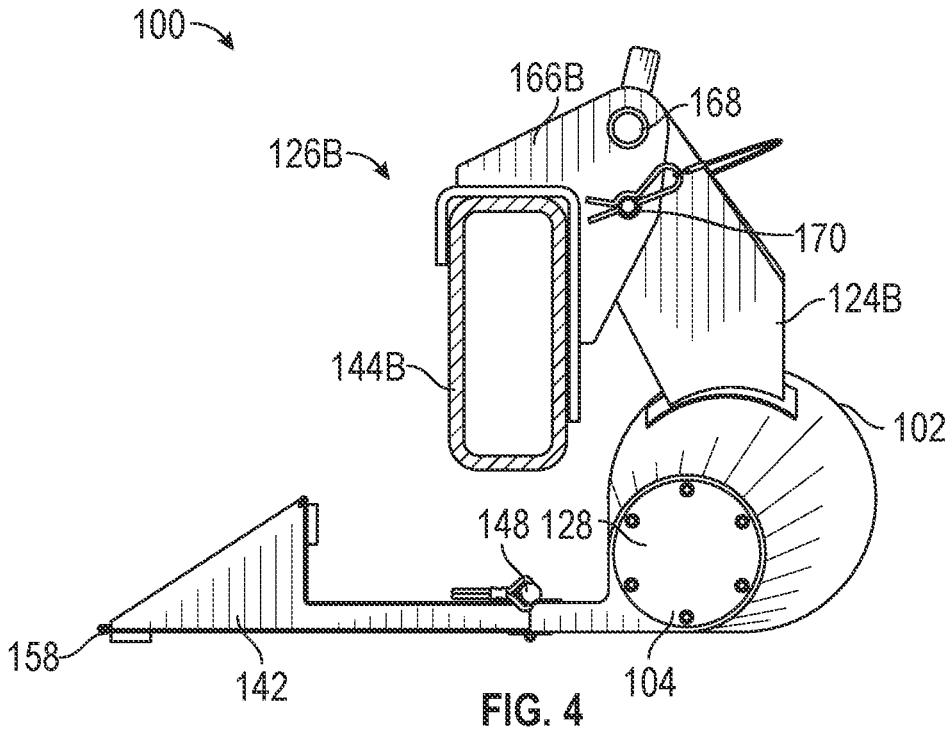
FIG. 4 is a sectional view of the dust hood of FIG. 1 taken along line 4-4 in FIG. 3.
Figure 5:
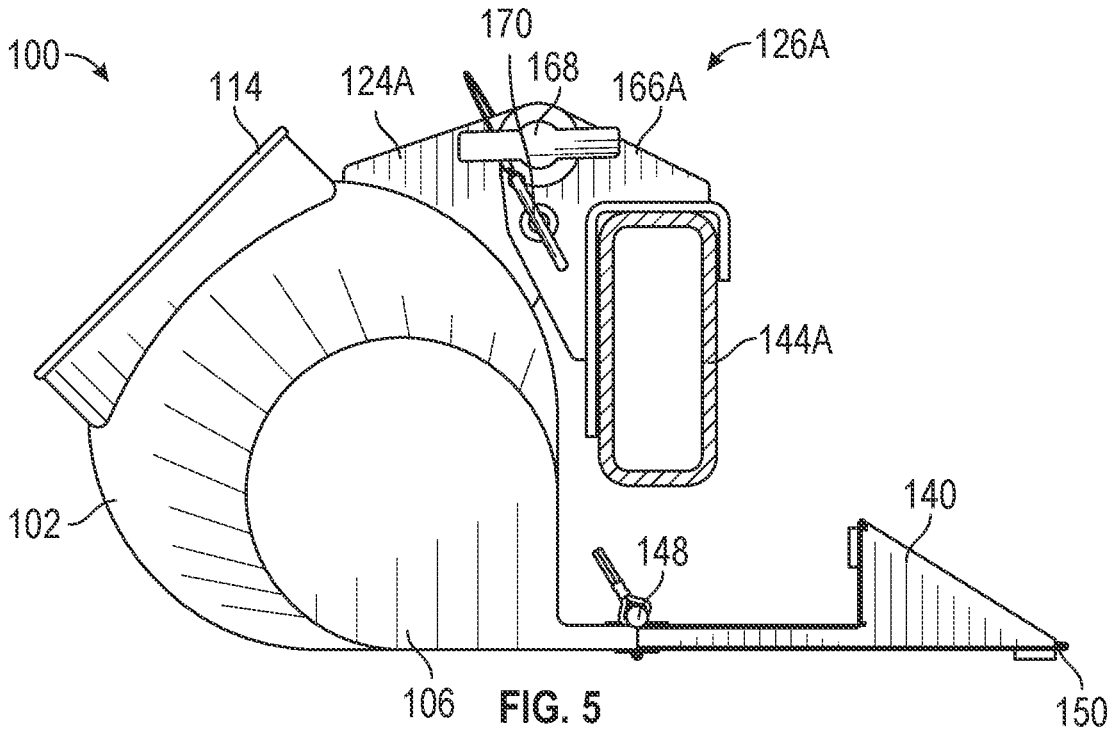
FIG. 5 is a sectional view of the dust hood of FIG. 1 taken along line 5-5 in FIG. 3.
Figure 6:
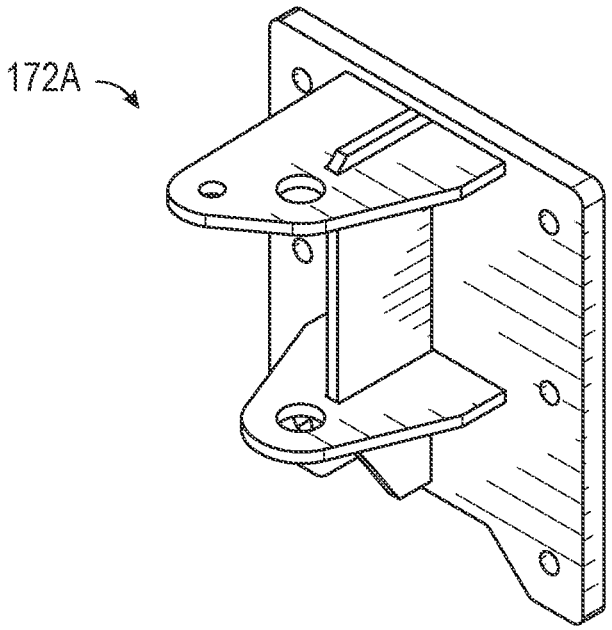
FIG. 6 is a perspective view of a support bracket of the dust hood of FIG. 1 according to aspects of the present disclosure.
Figure 7:
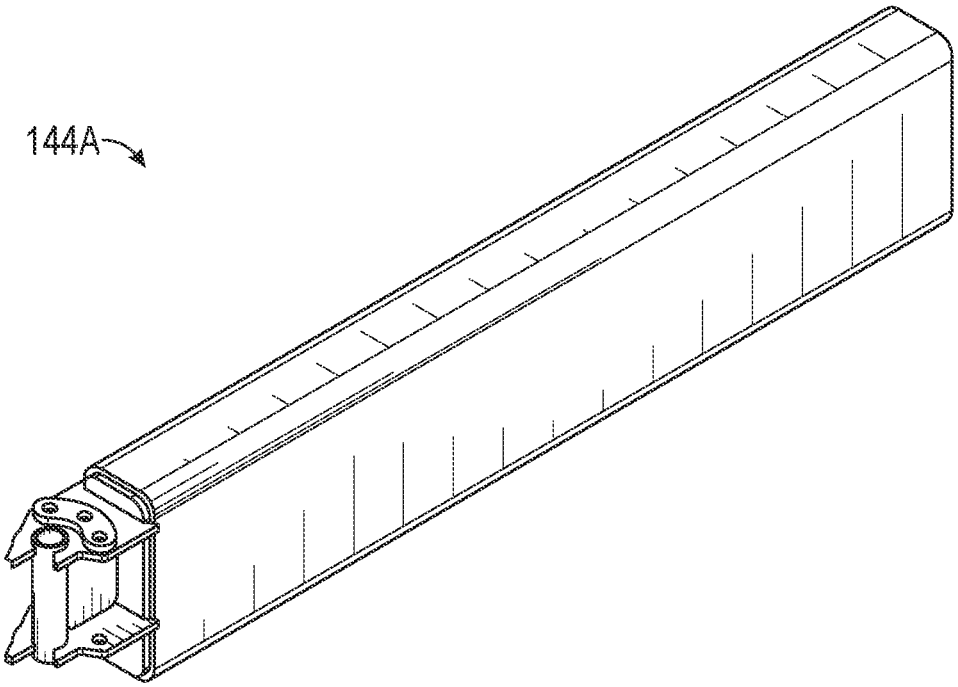
FIG. 7 is a perspective view of a support of the dust hood of FIG. 1 according to aspects of the present disclosure.
Figure 8:
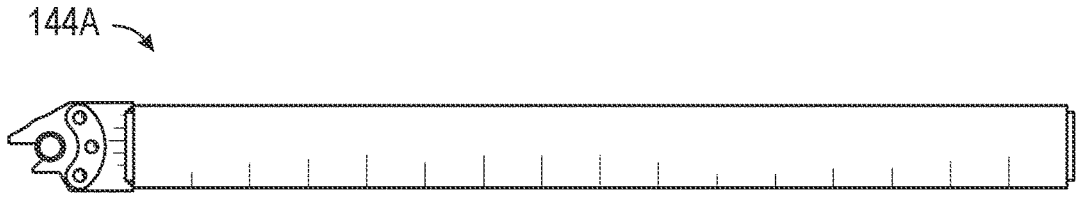
FIG. 8 is a top view of the support of FIG. 7.
Figure 9:
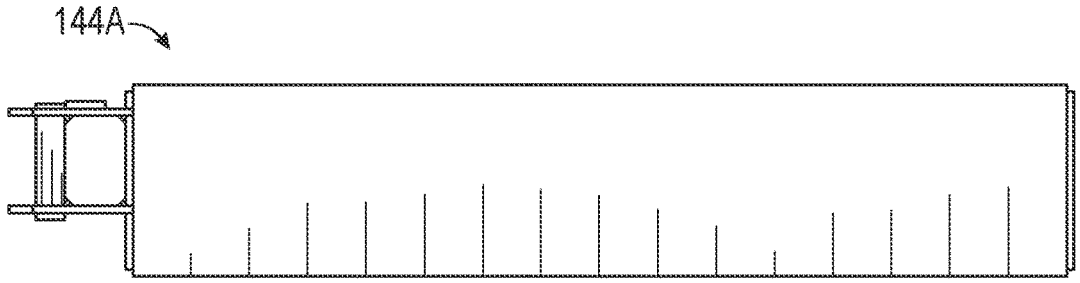
FIG. 9 is a side view of the support of FIG. 7.
Figure 10:
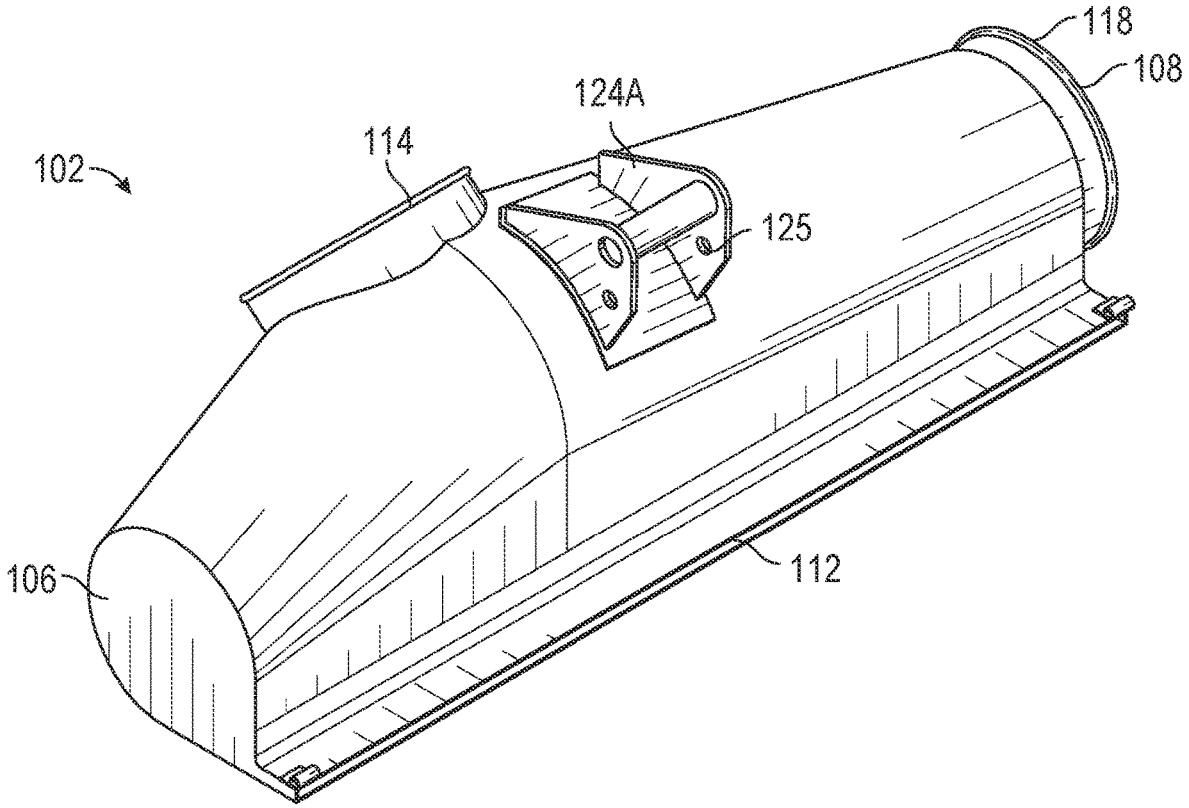
FIG. 10 is a perspective view of a first hood body of the dust hood of FIG. 1 according to aspects of the present disclosure.
Figure 11:
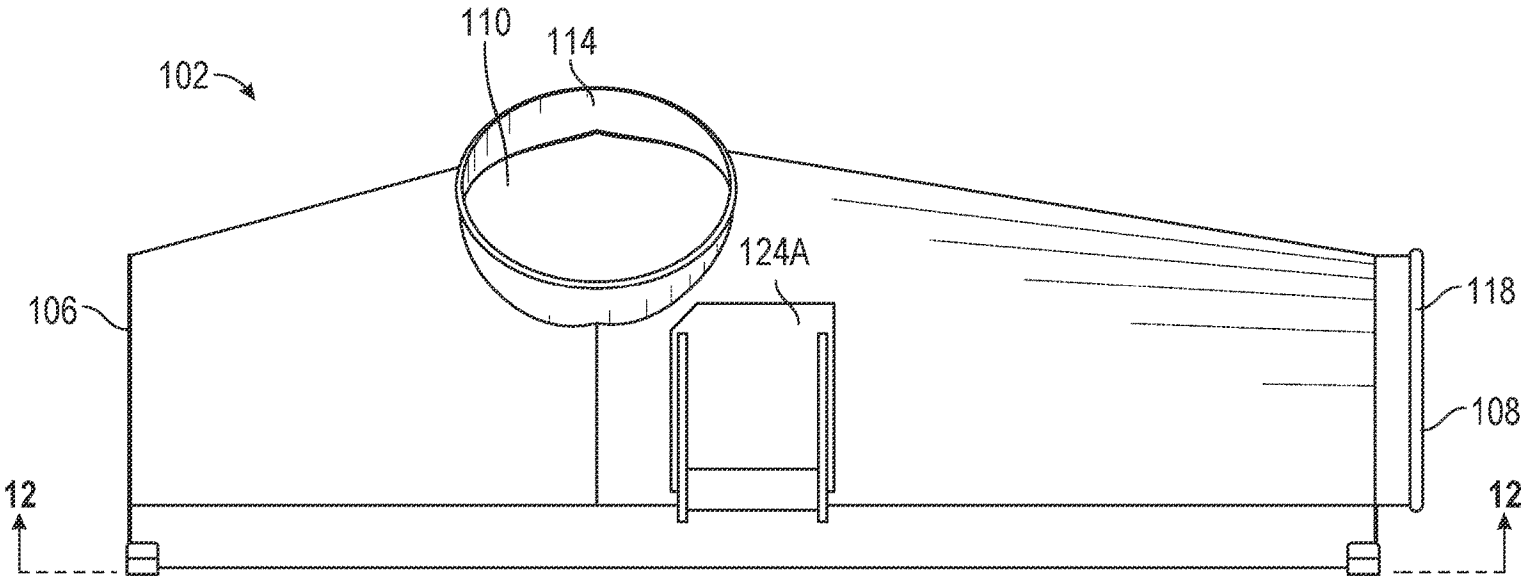
FIG. 11 is a top view of the first hood body of FIG. 10.
Figure 12:
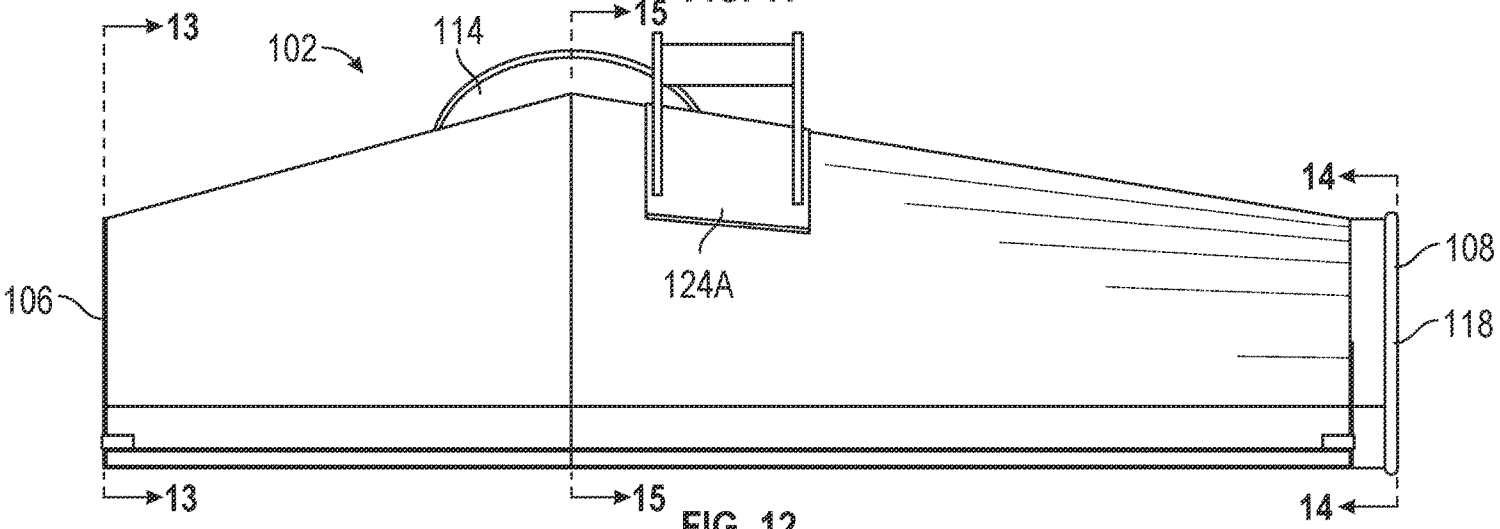
FIG. 12 is a side view of the first hood body of FIG. 10.
Figure 13:
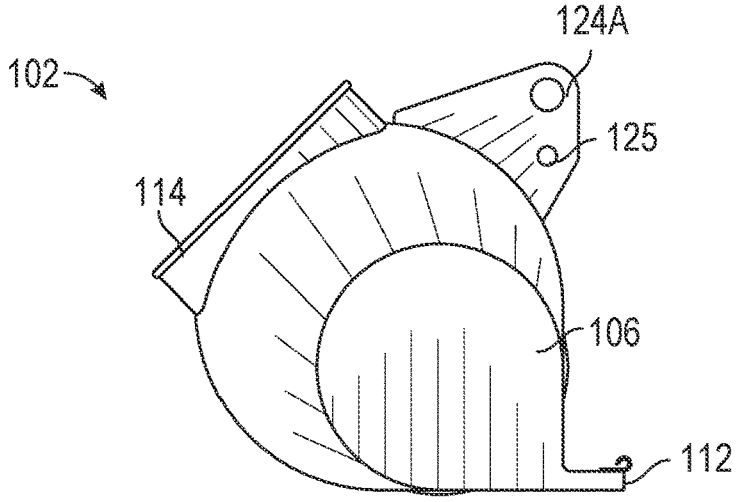
FIG. 13 is a sectional view of the first hood body of FIG. 10 taken along line 13-13 in FIG. 12.
Figure 14:
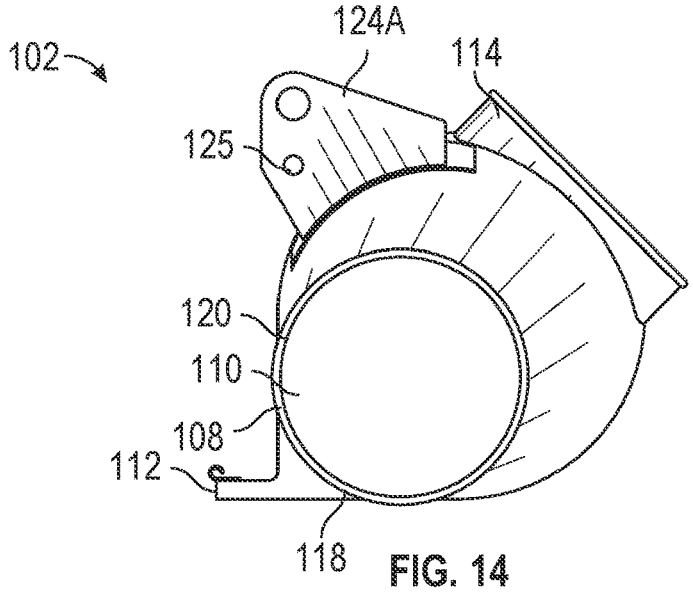
FIG. 14 is a sectional view of the first hood body of FIG. 10 taken along line 14-14 in FIG. 12.
Figure 15:
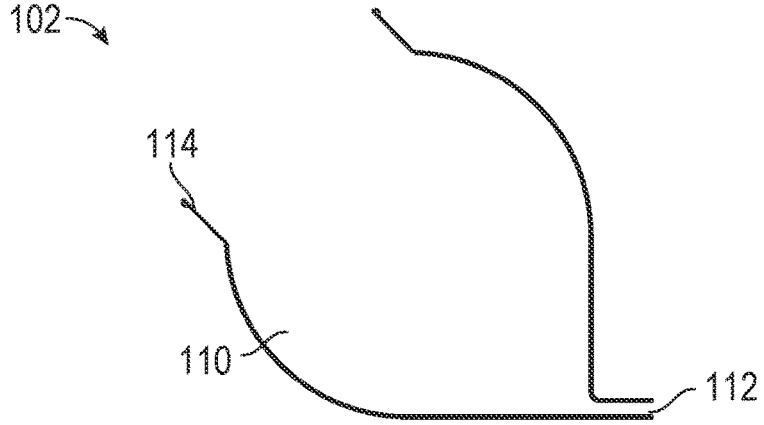
FIG. 15 is a sectional view of the first hood body of FIG. 10 taken along line 15-15 in FIG. 12.
Figure 16:
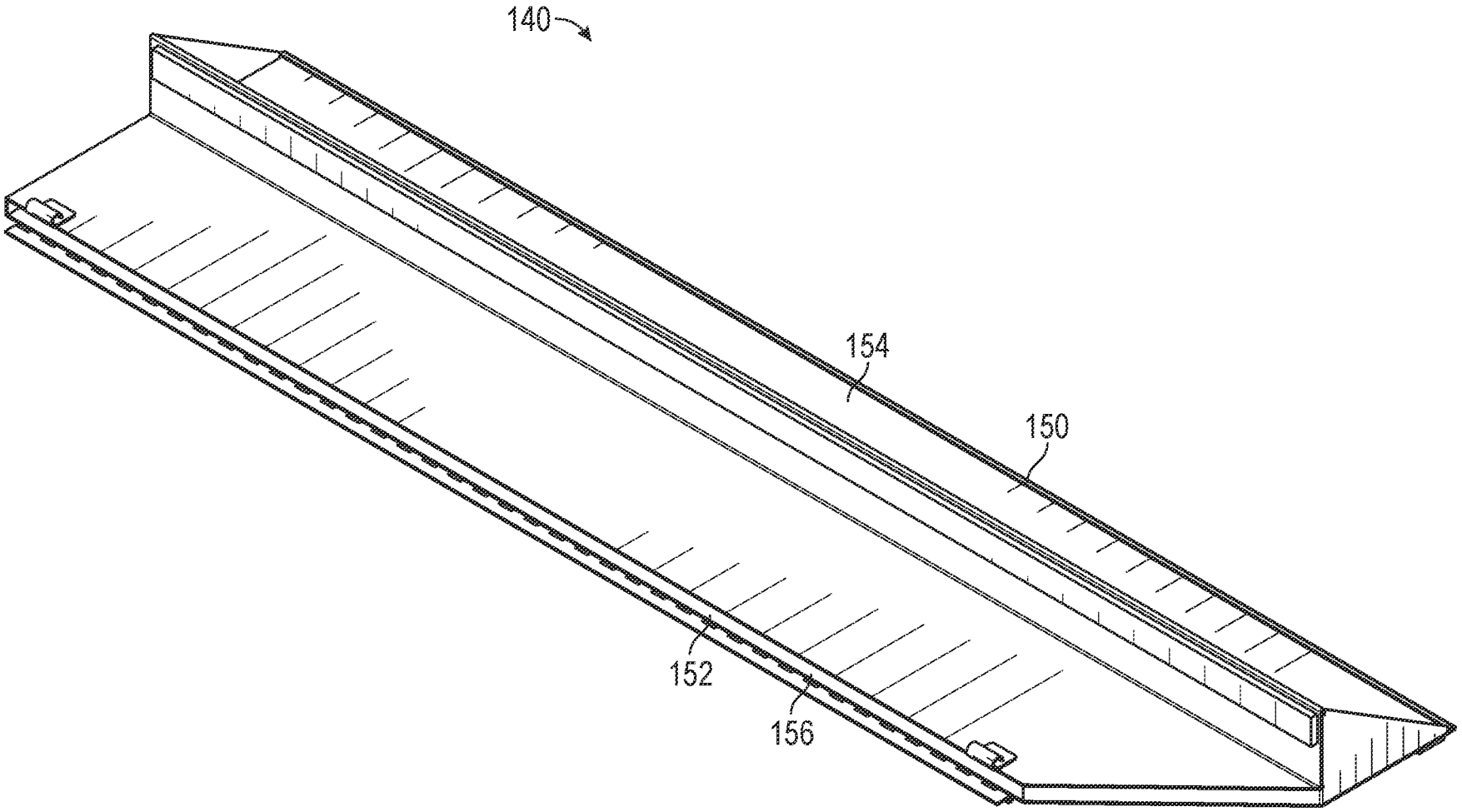
FIG. 16 is a perspective view of a first suction mouthpiece of the dust hood of FIG. 1 according to aspects of the present disclosure.
Figure 17:
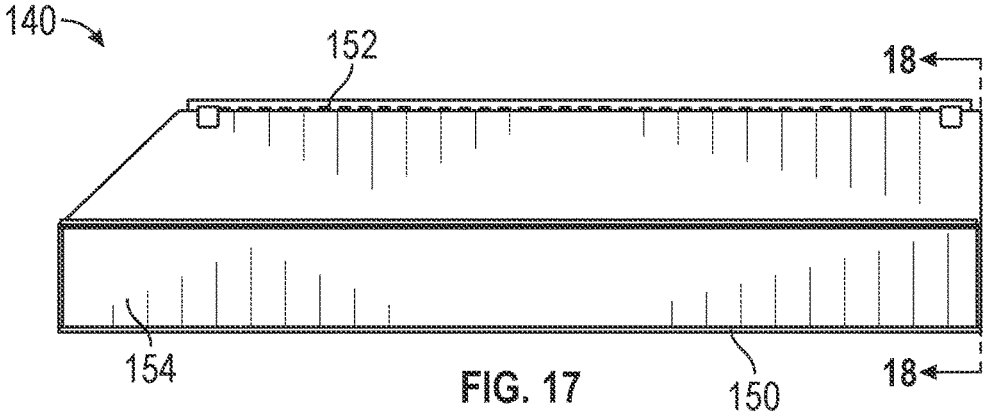
FIG. 17 is a top view of the first suction mouthpiece of FIG. 16.
Figure 18:
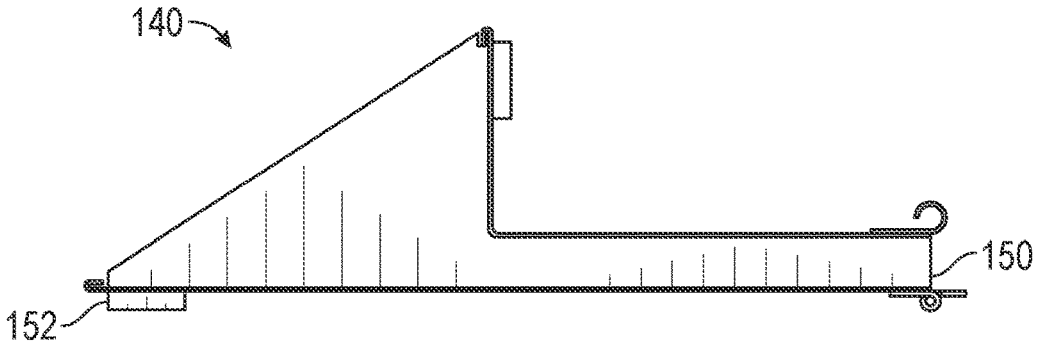
FIG. 18 is a sectional view of the first suction mouthpiece of FIG. 16 taken along line 18-18 in FIG. 17.
Figure 19:
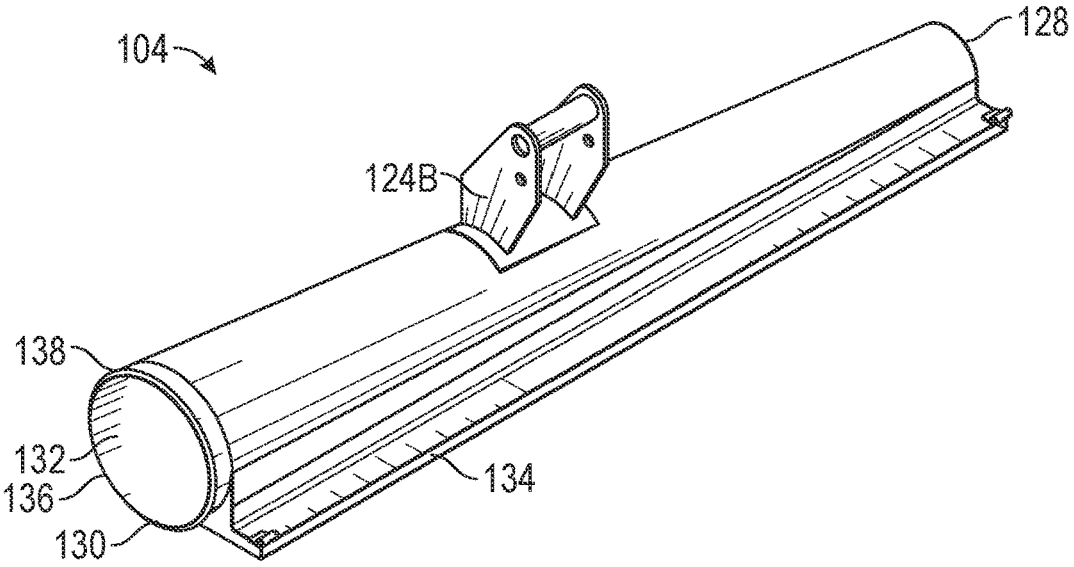
FIG. 19 is a perspective view of a second hood body of the dust hood of FIG. 1 according to aspects of the present disclosure.
Figure 20:
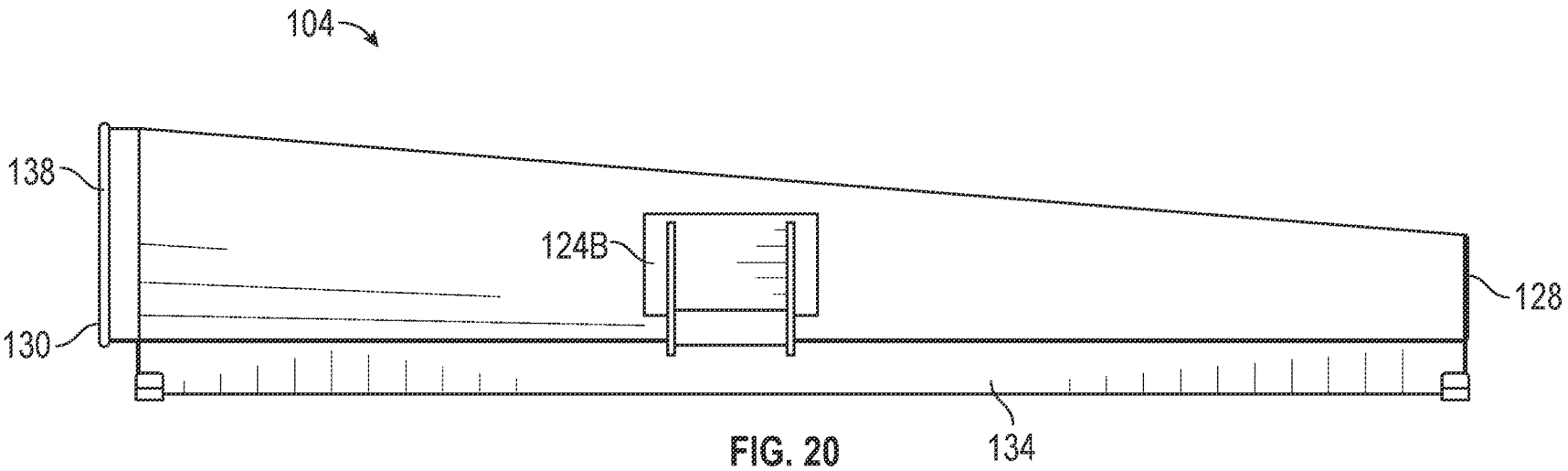
FIG. 20 is a top view of the second hood body of FIG. 19.
Figure 21:
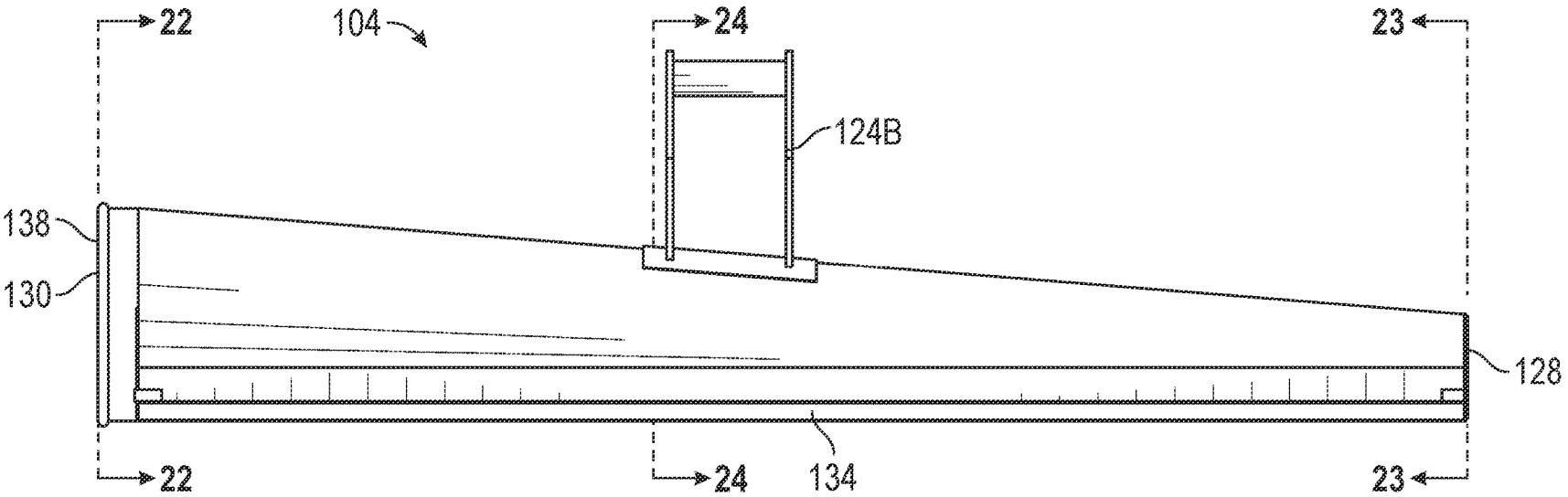
FIG. 21 is a side view of the second hood body of FIG. 19.
Figure 22:
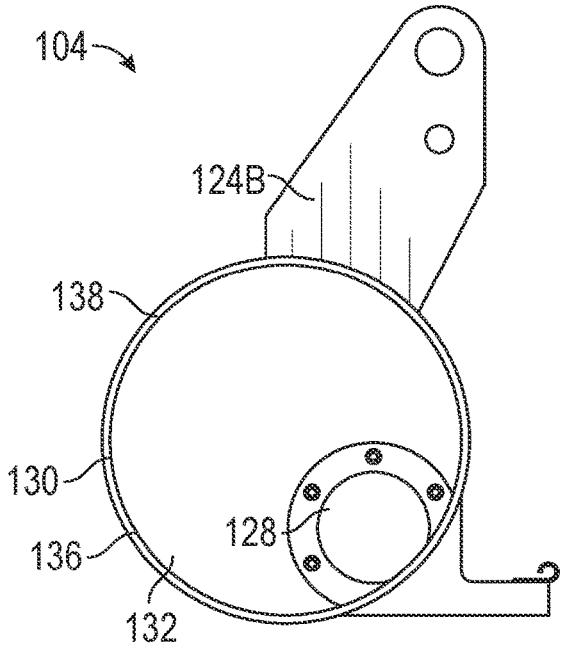
FIG. 22 is a sectional view of the second hood body of FIG. 19 taken along line 22-22 in FIG. 21.
Figure 23:
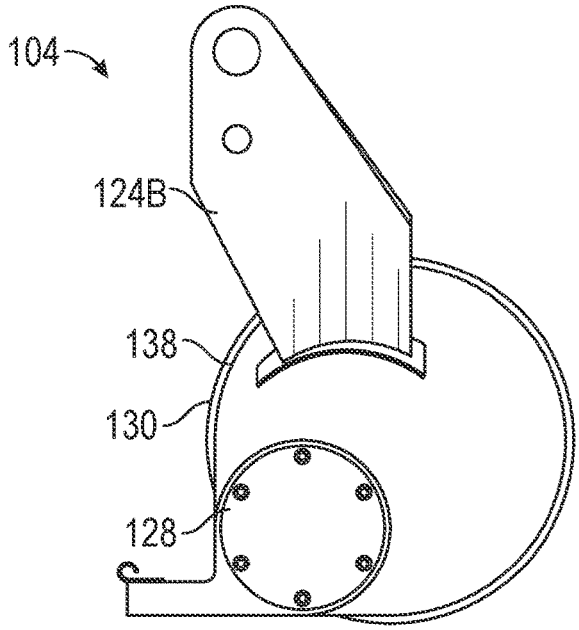
FIG. 23 is a sectional view of the second hood body of FIG. 19 taken along line 23-23 in FIG. 21.
Figure 24:
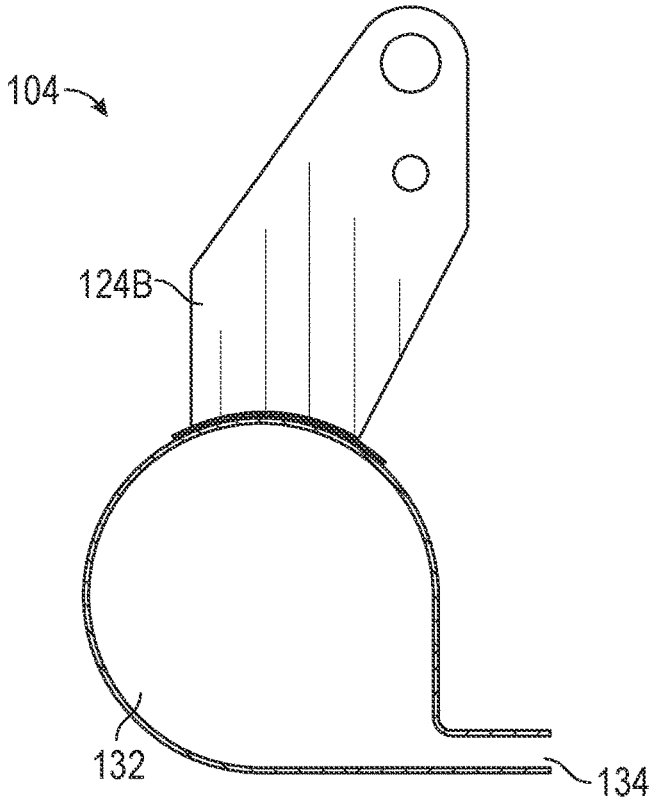
FIG. 24 is a sectional view of the second hood body of FIG. 19 taken along line 24-24 in FIG. 21.
Figure 25:
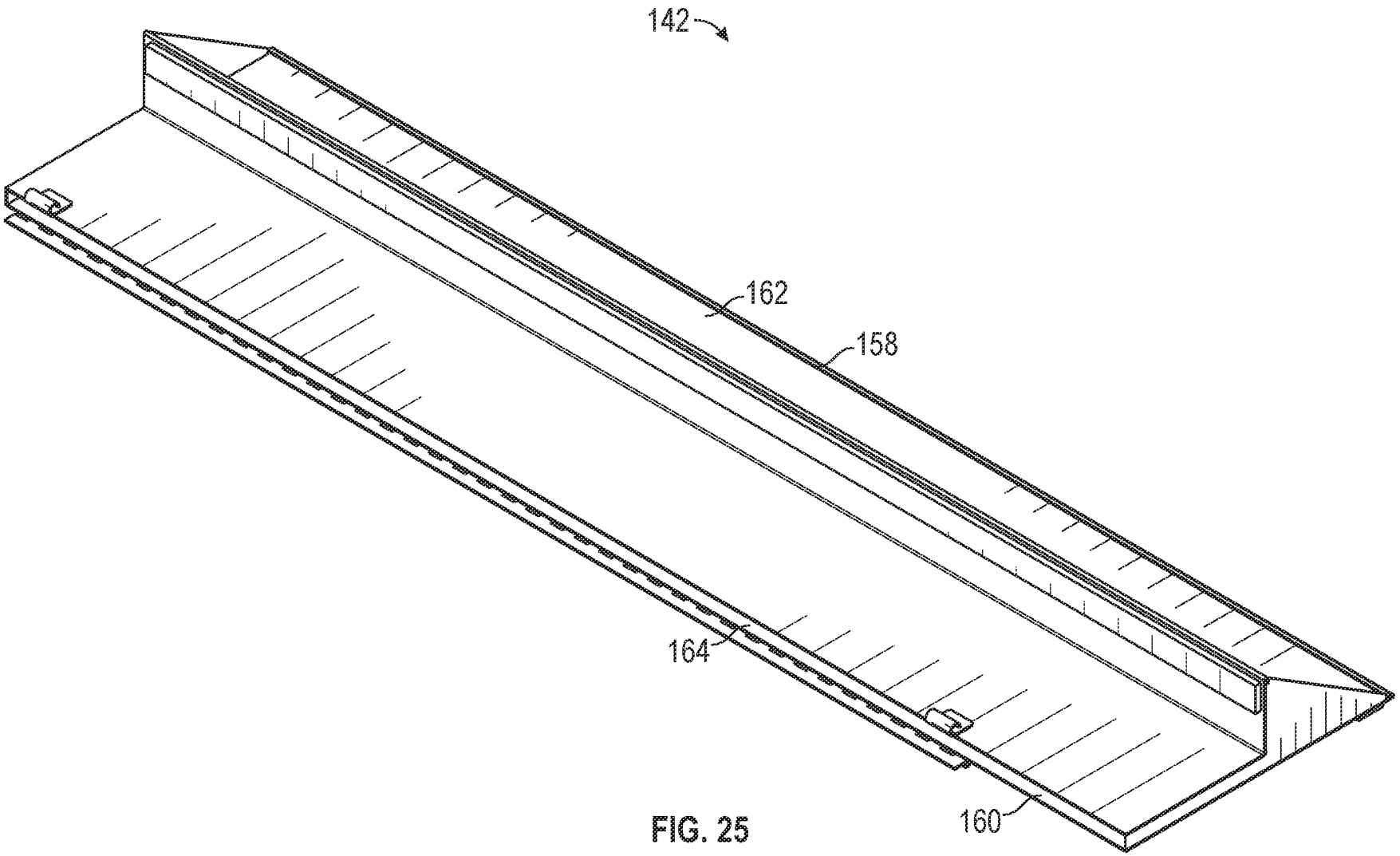
FIG. 25 is a perspective view of a second suction mouthpiece of the dust hood of FIG. 1 according to examples of the present disclosure.
Figure 26:
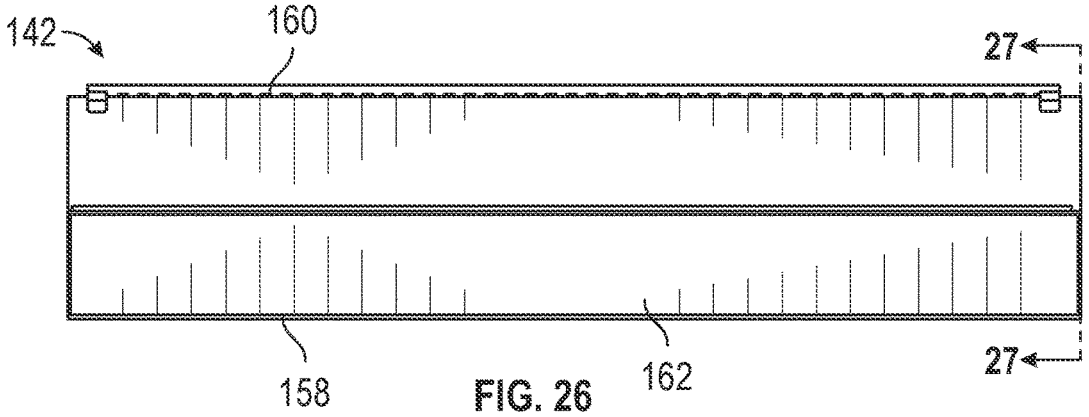
FIG. 26 is a top view of the second suction mouthpiece of FIG. 25.
Figure 27:
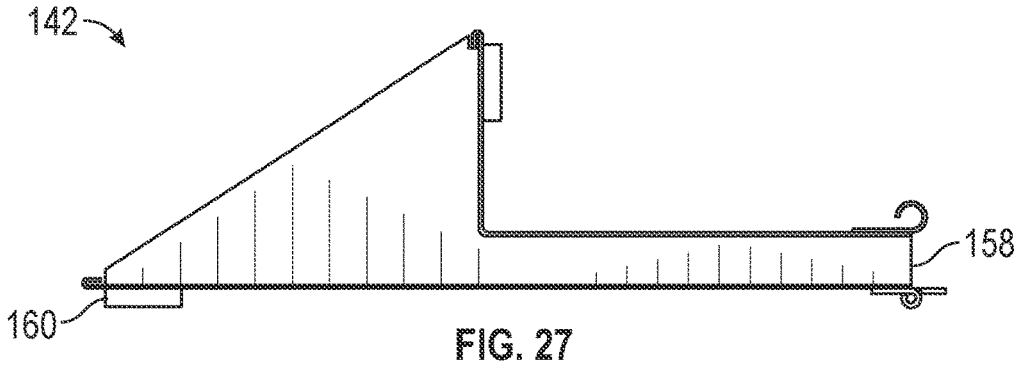
FIG. 27 is a sectional view of the second suction mouthpiece of FIG. 25 taken along line 27-27 in FIG. 26.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing.

In one aspect, disclosed is a dust hood for a dust control system. The dust hood includes a first hood body and a second hood body. The first hood body and the second hood body are removably attached to each other through a clamp or other suitable removable securing device. In various examples, the removable securing device allows for the first hood body and the second hood body to be quickly connected together (e.g., prior to using the dust hood on a winder) or disassembled (e.g., when a worker needs to access the first hood body, second hood body, components of the winder, etc.). In some non-limiting examples, the clamp is a quick opening clamp. In various non-limiting examples, the quick opening clamp is movable between a secured position (e.g., where the quick opening clamp secures the first hood body and the second hood body together) and an open position (e.g., where the quick opening clamp allows for the first hood body and the second hood body to detach). In certain examples, a diameter of the clamp in the secured position is less than a diameter of the clamp in the open position, although it need not be. In some non-limiting examples, the first hood body and the second hood body are each hingedly supported on opposing ends such that the first hood body and second hood body can independently pivot relative to each other and allow for the worker to access the desired area.

FIGS. 1-28 illustrate various aspects of a dust hood 100 according to examples of the present disclosure. In various examples, the dust hood 100 includes a first hood body 102 and a second hood body 104. In addition to the first hood body 102 and the second hood body 104, the dust hood 100 may also include a first suction mouthpiece 140, a second suction mouthpiece 142, a first support frame 144A, and/or a second support frame 144B.

Referring to FIGS. 1-3, 5, and 10-15, the first hood body 102 includes a first end 106 and a second end 108 opposite from the first end 106. The shape of the first hood body 102 should not be considered limiting on the current disclosure. The first hood body 102 defines a chamber 110 having an inlet 112. In some examples, the inlet 112 extends along a length of the first hood body 102 from the first end 106 to the second end 108, although in other examples, the inlet 112 need not extend along the entire length. Optionally, the first hood body 102 includes an outlet 114 that is in fluid communication with the chamber 110. In other examples, the outlet 114 may be provided on the second hood body 104 rather than on the first hood body 102 or in addition to the outlet 114 on the first hood body 102. The number or location of the outlets 114 for the dust hood 100 should not be considered limiting on the current disclosure.

In some cases, the first end 106 of the first hood body 102 is closed and the second end 108 defines an opening 120 that is in fluid communication with the chamber 110. As described in detail below, in various aspects, the chamber 110 is in fluid communication with a chamber of the second hood body 104 through the opening 120. In various examples, a shoulder 118 is provided at the second end 108. As described in detail below, in some cases, the shoulder 118 facilitates the engagement of a removable securing device 122 with the first hood body 102 to removably secure the first hood body 102 with the second hood body 104.

The first hood body 102 may further include a first portion 124A of a frame mount 126A. As described in detail below, in some cases, the first hood body 102 is supported on a support frame through the frame mount 126A. Optionally, the first portion 124A defines at least one locking aperture 125 that is configured to receive a locking pin of the frame mount 126A such that a position or angle of rotation of the first hood body 102 relative to the support frame can be maintained.

Referring to FIGS. 1-4 and 19-24, the second hood body 104 includes a first end 128 and a second end 130 opposite from the first end 128. The shape of the second hood body 104 should not be considered limiting on the current disclosure. The second hood body 104 defines a chamber 132 having an inlet 134. In some examples, the inlet 134 extends along a length of the second hood body 104 from the first end 128 to the second end 130, although in other examples, the inlet 134 need not extend along the entire length. As mentioned, in some optional examples, an outlet in fluid communication with the chamber 132 may be included with the second hood body 104 in addition to or in place of the outlet 114 of the first hood body 102.

In some cases, the first end 128 of the second hood body 104 is closed and the second end 130 defines an opening 136 that is in fluid communication with the chamber 132. In certain aspects, the first end 106 of the first hood body 102 is one end of the dust hood 100 and the first end 128 of the second hood body 104 is an opposing end of the dust hood 100. In various cases, a shoulder 138 is provided at the second end 130 of the second hood body 104. Similar to the shoulder 118, the shoulder 138 may facilitate the engagement of the removable securing device 122 with the second hood body 104 to removably secure the first hood body 102 with the second hood body 104. In various examples, the first hood body 102 and the second hood body 104 are assembled such that the second ends 108 and 130 are adjacent to one another and the opening 136 is aligned with the opening 120 such that the chambers 110 and 132 are in fluid communication.

Similar to the first hood body 102, the second hood body 104 may further include a first portion 124B of a frame mount 126B. In some cases, the second hood body 104 is supported on a support frame through the frame mount 126B. Optionally, the first portion 124B defines at least one locking aperture 125 that is configured to receive a locking pin of the frame mount 126B such that a position or angle of rotation of the second hood body 104 relative to the support frame can be maintained.

Referring to FIGS. 1-3, 5, and 16-18, in various examples, the first suction mouthpiece 140 is provided with the first hood body 102. In various examples, the first suction mouthpiece 140 is hingedly attached to the first hood body 102 through at least one locking pin 148 such that the first suction mouthpiece 140 is movable relative to the first hood body 102. The locking pin 148 may be removable from the first hood body 102 and/or the first suction mouthpiece 140, although it need not be in other examples. Although the locking pin 148 is illustrated, in other examples, the first suction mouthpiece 140 may be movably attached to the first hood body 102 through various other suitable mechanisms. In further examples, the first suction mouthpiece 140 may be fixedly attached to the first hood body 102 through various suitable mechanisms such that the position of the first suction mouthpiece 140 is maintained relative to the first hood body 102.

The first suction mouthpiece 140 includes a front end 150 and a back end 152 opposite from the front end 150. The shape of the first suction mouthpiece 140 should not be considered limiting on the current disclosure. In various examples, the front end 150 defines an inlet 154 and the back end 152 defines an outlet 156. In certain examples, the first suction mouthpiece 140 is assembled with the first hood body 102 such that the outlet 156 of the first suction mouthpiece is in fluid communication with the inlet 112 of the first hood body 102. During use, and as described in detail below, air and dust (or other debris) may be pulled into the chamber 110 through the first suction mouthpiece 140.

Referring to FIGS. 1-4 and 25-27, the second suction mouthpiece 142 is provided with the second hood body 104. In various examples, the second suction mouthpiece 142 is hingedly attached to the second hood body 104 through at least one locking pin 148 such that the second suction mouthpiece 142 is movable relative to the second hood body 104. The locking pin 148 may be removable from the second hood body 104 and/or the second suction mouthpiece 142, although it need not be in other examples. In other examples, the second suction mouthpiece 142 may be movably attached to the second hood body 104 through various other suitable mechanisms. In further examples, the second suction mouthpiece 142 may be fixedly attached to the second hood body 104 through various suitable mechanisms such that the position of the second suction mouthpiece 142 is maintained relative to the second hood body 104.

The second suction mouthpiece 142 includes a front end 158 and a back end 160 opposite from the front end 158. The shape of the second suction mouthpiece 142 should not be considered limiting on the current disclosure. In various examples, the front end 158 defines an inlet 162 and the back end 160 defines an outlet 164. In certain examples, the second suction mouthpiece 142 is assembled with the second hood body 104 such that the outlet 164 of the second suction mouthpiece 142 is in fluid communication with the inlet 134 of the second hood body 104. During use, and as described in detail below, air and dust (or other debris) may be pulled into the chamber 132 through the second suction mouthpiece 142.

Figure 28:
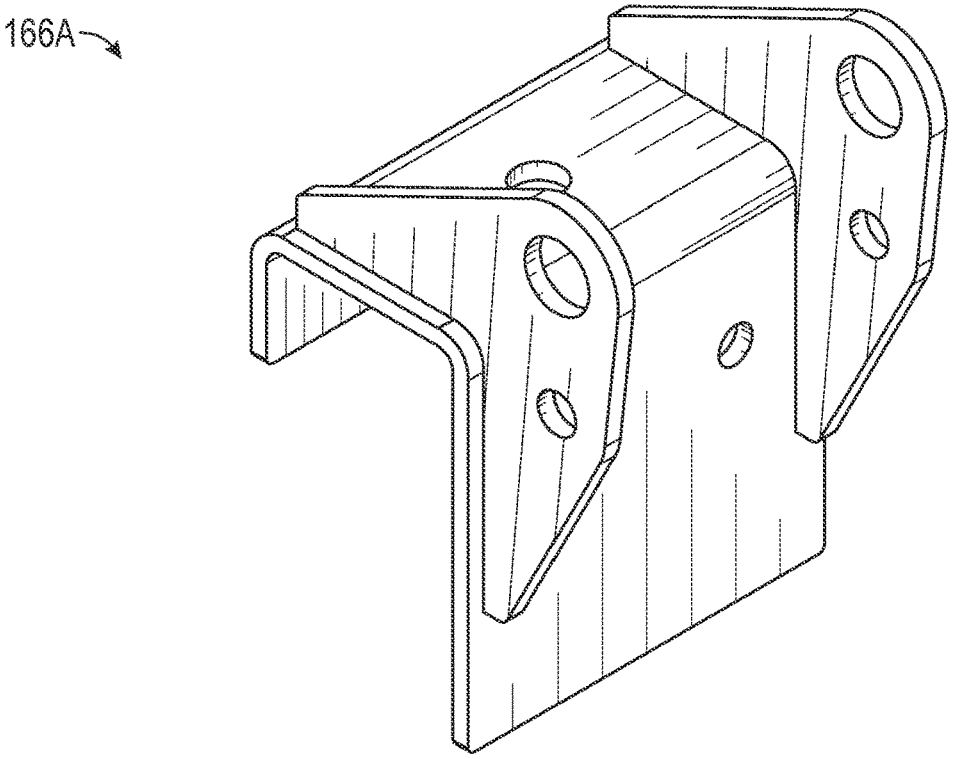
FIG. 28 is a perspective view of a support bracket of the dust hood of FIG. 1 according to aspects of the present disclosure.

Referring to FIGS. 1-9 and 28, in various examples, the first hood body 102 is supported on a first support frame 144A and the second hood body 104 is supported on a second support frame 144B. The second support frame 144B is substantially similar to the first support frame 144A, and the following description is equally applicable to both the support frames 144A-B even if not explicitly mentioned. In certain examples, the frame mount 126A hingedly supports the first hood body 102 on the first support frame 144A such that the first hood body 102 is movable relative to the first support frame 144A. Similarly, the frame mount 126B hingedly supports the second hood body 104 on the second support frame 144B such that the second hood body 104 is movable relative to the second support frame 144B. In addition to the first portions 124A-B, the frame mounts 126A-B include second portions 166A-B that are connected to the support frames 144A-B, respectively. The second portion 166 is illustrated in FIG. 28. In various aspects, the first portions 124A-B are rotatable relative to the second portions 166A-B, respectively, about pins 168 such that the hood bodies are rotatable relative to the support frames through various angles of rotation. In various examples, the first hood body 102 is rotatable about an axis 105 relative to the support frame 144A and the second hood body 104 is rotatable about an axis 107 relative to the support frame 144B through the frame mounts 126A-B, respectively. In other examples, various other suitable mechanisms may be used in addition to or in place of the frame mount 126 such that the first hood body 102 and the second hood body 104 are independently movable relative to the support frames 144A-B, respectively.

In some examples, the angle of rotation of the first hood body 102 about the axis 105 may be different than the angle of rotation of the second hood body 104 about the axis 107, although it need not be. In various aspects, the angle of rotation of the first hood body 102 and/or the second hood body 104 may be less than about 360°, such as less than about 270°. It will be appreciated that when the first hood body 102 and the second hood body 104 are detached (i.e., the securing device 122 does not secure the bodies together), the axis 105 of the first hood body 102 may not align with the axis 107 of the second hood body 104. In some cases, when the first hood body 102 is assembled with the second hood body 104, the axis 105 may be substantially parallel and/or aligned with the axis 107.

In various examples, the hood bodies 102 and 104 may rotate jointly about the aligned axes 105 and 107 when the securing device 122 secures the hood bodies 102 and 104 together. As mentioned, in some examples, a locking pin 170 may maintain a position (e.g., angle of rotation) of the second hood body 104 relative to the second support frame 144B. Similarly, a locking pin 170 may maintain a position of the first hood body 102 relative to the first support frame 144A. In some aspects, the locking pin 170 maintains the position of the hood bodies by engaging one or more apertures 125 defined in the frame mount 126. In other examples, various other suitable mechanisms for movably supporting the hood bodies on the respective support frames may be utilized. In further examples, one or both of the hood bodies may be fixedly attached to the respective support such that a position of the hood body is maintained relative to the support frame.

In some cases, the first hood body 102 may be hingedly supported on a support bracket 172A through the support frame 144A. In certain examples, the support frame 144A rotates about a pin 174A such that the first hood body 102 and support frame 144A can rotate about the axis 101 when detached from the second hood body 104. In some examples, a locking pin 176A may maintain a position (e.g., angle of rotation) of the support frame 144A (and thus the first hood body 102) relative to the support bracket 172A by selectively engaging one or more openings on the support frame 144A and/or the support bracket 172A. In some examples, the axis 101 is substantially perpendicular to the axis 105, although it need not be in other examples.

Similarly, the second hood body 104 may be hingedly supported on a support bracket 172B, which is substantially similar to the support bracket 172A. In such examples, the second hood body 104 and support frame 144B can rotate about a pin 174B such that the second hood body 104 and support frame 144B can rotate about the axis 103 when detached from the first hood body 102. A locking pin 176B may similarly maintain a position or angle of rotation of the support frame 144B relative to the support bracket 172B. In other examples, various other suitable mechanisms for movably supporting the support frames on the respective support brackets may be utilized. In some examples, the axis 103 is substantially perpendicular to the axis 107, although it need not be in other examples.

In some examples, the angle of rotation of the support frame 144B and/or the support frame 144A relative to the support brackets 172A-B, respectively, may be less than 180°, such as less than 90°. In one non-limiting example, the angle of rotation may be from about 45° to about 90°, such as about 45°, about 46°, about 47°, about 48°, about 49°, about 50°, about 51°, about 52°, about 53°, about 54°, about 55°, about 56°, about 57°, about 58°, about 59°, about 60°, about 61°, about 62°, about 63°, about 64°, about 65°, about 66°, about 67°, about 68°, about 69°, about 70°, about 71°, about 72°, about 73°, about 74°, about 75°, about 76°, about 77°, about 78°, about 79°, about 80°, about 81°, about 82°, about 83°, about 84°, about 85°, about 86°, about 87°, about 88°, about 89°, and/or about 90°. In other examples, the angle of rotation may be less than 45° and/or greater than 180°. In certain cases, the angle of rotation of the support frame 144B about the axis 103 may be different from the angle of rotation of the support frame 144A about the axis 101, although it need not be.

As mentioned, the removable securing device 122 removably secures the first hood body 102 with the second hood body 104. In some aspects, the removable securing device 122 may be a quick opening clamp. In other examples, the removable securing device 122 may be various other suitable securing devices or mechanisms to selectively secure the first hood body 102 with the second hood body 104. In various non-limiting examples, the removable securing device 122 is movable between a secured position (e.g., where the removable securing device 122 secures the first hood body and the second hood body together) and an open position (e.g., where the removable securing device 122 allows for the first hood body and the second hood body to detach). In certain examples, a diameter of the removable securing device 122 in the secured position is less than a diameter of the removable securing device 122 in the open position, although it need not be.

In some cases, the removable securing device 122 includes an alignment pin 123 such that the first hood body 102 and the second hood body 104 can be secured together in a predetermined configuration. In various cases, the predetermined configuration includes having the suction mouthpieces 140 and 142 facing the same direction. In other examples, the predetermined configuration may include various other configurations of the components of the dust hood 100 and/or dust hood bodies 102 and 104 relative to one another. In some aspects, the removable securing device 122, first hood body 102, and/or second hood body 104 include apertures that are configured to receive the alignment pin 123. In various aspects, the first hood body 102 and the second hood body 104 are maintained in the particular configuration with the alignment pin 123 prior to positioning of the removable securing device 122 in the secured position, although it need not be in other examples. In some cases, the alignment pin 123 may further selectively maintain the removable securing device 122 in the secured position, although it need not in other examples.

Although an alignment pin 123 is illustrated, in other examples, the removable securing device 122 may include various other suitable devices or mechanisms for positioning the first hood body 102 and the second hood body 104 in a particular configuration, including, but not limited to, alignment ribs, hooks, pins, clips, clasps, combinations thereof, or various other suitable mechanisms.

During use, air, dust, and/or other debris or materials are pulled through the suction mouthpieces 140 and 142, into the hood bodies 102 and 104, and out the outlet 114. As mentioned, the outlet 114 may be in the first hood body 102 or the second hood body 104. In other examples, more than one outlet 114 may be provided. For example, an outlet 114 may be provided on both the first hood body 102 and the second hood body 104, a plurality of exit ports may be provided on the first hood body 102, and/or a plurality of outlets 114 may be provided on the second hood body 104.

Through the securing device 122, a worker may quickly assemble the first hood body 102 and the second hood body 104 (e.g., prior to use). The worker may also quickly disassemble the first hood body 102 and the second hood body 104 and/or move the bodies 102 and 104 into or out of the workspace as needed (e.g., to access a winder, the first hood body 102, the second hood body 104, etc.). Because the dust hood 100 can be quickly assembled and/or disassembled and/or moved out of position, the dust hood 100 can be provided in areas of the tissue, towel, and paper manufacturing and converting systems that require frequent access by the worker.

Figure 29:
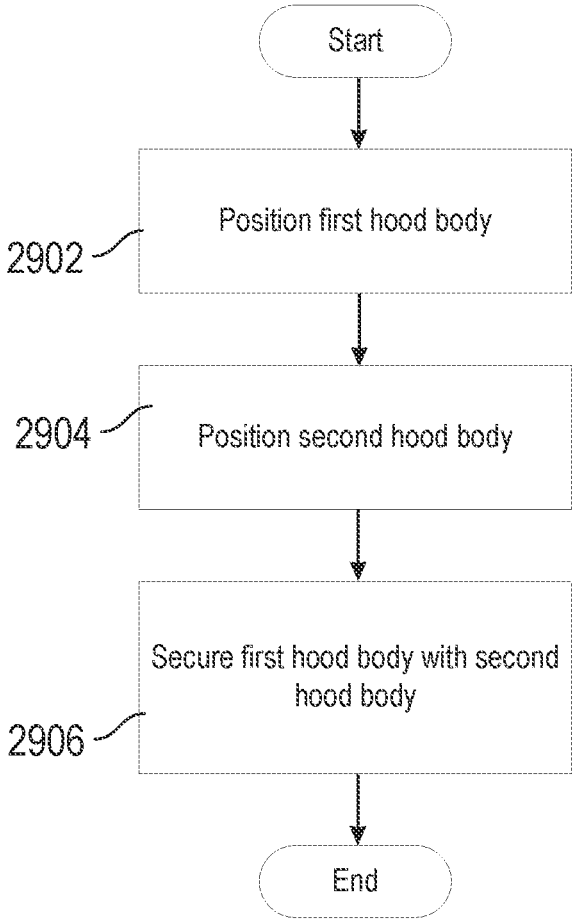
FIG. 29 is a flowchart of a method of assembling a dust hood according to examples of the present disclosure.

FIG. 29 is a flowchart of a method of assembling the dust hood 100 according to various examples.

In a block 2902, the first hood body 102 is positioned. In some examples, positioning the first hood body 102 includes supporting the first suction mouthpiece 140 on the first hood body 102 such that the outlet 156 of the first suction mouthpiece is in fluid communication with the inlet 112 of the first hood body 102. In various examples, positioning the first hood body 102 includes supporting the first hood body 102 on the first support frame 144A through the frame mount 126A. In certain examples, supporting the first hood body 102 on the first support frame 144A includes rotating the first hood body 102 about the axis 105 to a desired position relative to the support frame 144A. In certain examples, positioning the first hood body 102 includes rotating the first hood body 102 about the axis 101 to a desired position relative to the support bracket 172A.

In a block 2904, the second hood body 104 is positioned. In some examples, positioning the second hood body 104 includes supporting the second suction mouthpiece 142 on the second hood body 104 such that the outlet 164 of the second suction mouthpiece 142 is in fluid communication with the inlet 134 of the second hood body 104. In various examples, positioning the second hood body 104 includes supporting the second hood body 104 on the second support frame 144B through the frame mount 126B. In certain examples, supporting the second hood body 104 on the second support frame 144B includes rotating the second hood body 104 about the axis 107 to a desired position relative to the support frame 144B. In certain examples, positioning the second hood body 104 includes rotating the second hood body 104 about the axis 103 to a desired position relative to the support bracket 172B.

In some aspects, positioning the second hood body 104 includes positioning the second hood body 104 in an assembled position relative to the first hood body 102. In various examples, positioning the second hood body 104 relative to the first hood body 102 includes positioning the second end 108 of the first hood body 102 adjacent to the second end 130 of the second hood body 104 such that the openings 120 and 136 are adjacent to one another. In some aspects, positioning the second hood body 104 relative to the first hood body includes aligning the axis 105 with the axis 107. In various cases, positioning the second hood body 104 relative to the first hood body 102 includes positioning the second hood body 104 at a same angular position as the first hood body 102 about the axes 105 and 107. In other examples, positioning the second hood body 104 relative to the first hood body 102 includes positioning the second hood body 104 at a different angular position from the first hood body 102 about the axes 105 and 107.

In a block 2906, the second hood body 104 is secured with the first hood body 102. In various examples, securing the second hood body 104 with the first hood body 102 includes engaging the removable securing device 122 with the first hood body 102 and the second hood body 104. In some cases, engaging the removable securing device 122 with the first hood body 102 and the second hood body 104 includes engaging the removable securing device 122 with the shoulders 118 and 138 of the hood bodies. In some examples, securing the second hood body 104 with the first hood body 102 includes securing the second hood body 104 such that the chambers 110 and 132 are in fluid communication.

Optionally, the method includes activating the dust hood 100 such that air, dust, and/or other debris are pulled through the suction mouthpieces, into the hood bodies, and out the outlet 114. In some cases, block 2906 may be omitted, and the first hood body 102 and/or the second hood body 104 may be activated while separated or disassembled. In other optional examples, the dust hood 100 may not be activated until the first hood body 102 is secured with the second hood body 104.

In various examples, the first hood body 102 and second hood body 104 may be moved to a disassembled position as desired by removing the removable securing device 122 such that the hood bodies are not connected. The disassembled position may be a position in which the axes 105 and 107 are not aligned and/or the chambers 110 and 132 are not in fluid communication. In various aspects, the hood bodies may be moved to the disassembled position for transport (e.g., to provide a more compact shipping footprint), for selective access to a workspace as needed, for maintenance, repair, or replacement of the dust hood components, and or as otherwise desired.

Figure 30:
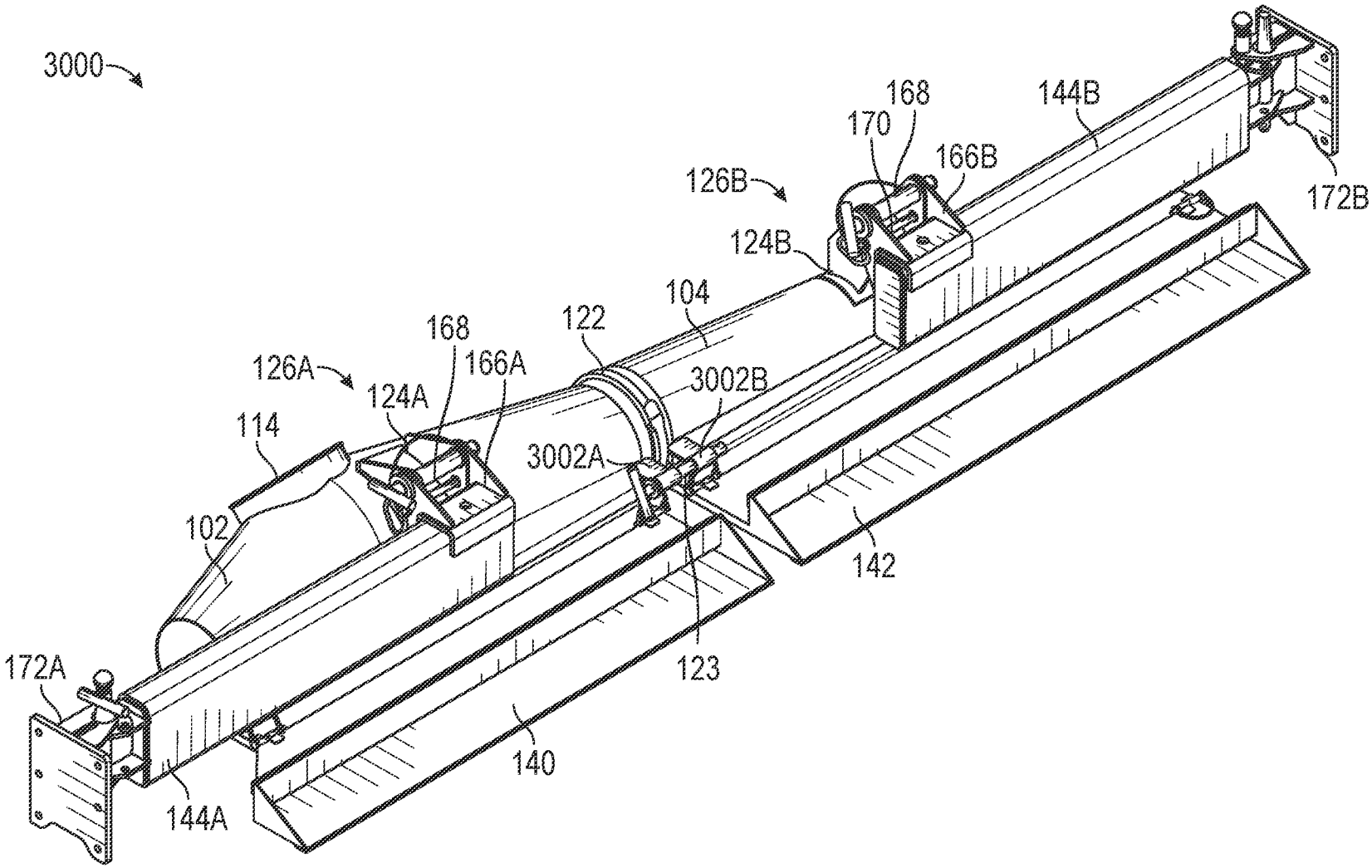
FIG. 30 is a perspective view of a dust hood according to aspects of the current disclosure.
Figure 31:
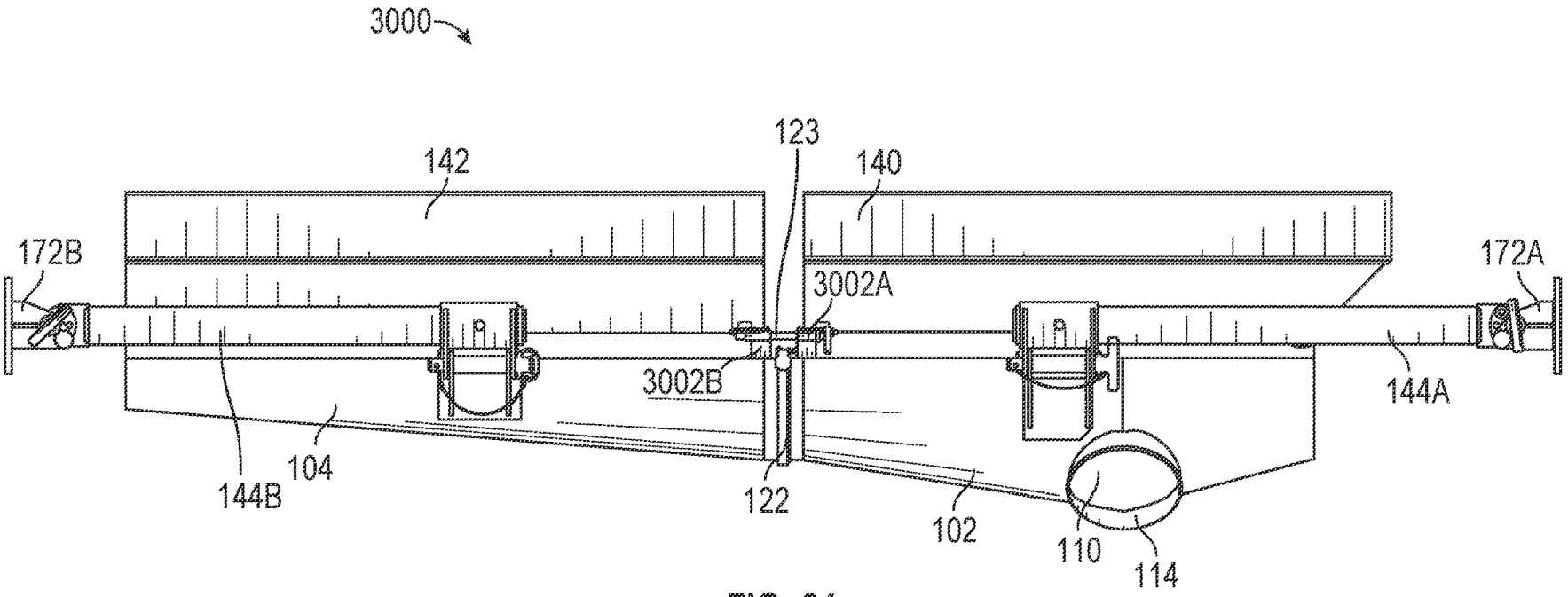
FIG. 31 is a top view of the dust hood of FIG. 30.

FIGS. 30 and 31 illustrate another example of a dust hood 3000. The dust hood 3000 is substantially similar to the dust hood 100 except that the first hood body 102 and the second hood body 104 each include alignment extensions 3002A-B for the alignment pin 123. In some cases, the alignment posts 3002A-B may be integrally or monolithically formed with the first hood body 102 and the second hood body 104, respectively, although they need not in other examples. In certain examples, the alignment posts 3002A-B are separate from the removable securing device 122, and the removable securing device need not accommodate the alignment pin 123. In various examples, the alignment pin 123 is removably positioned within the alignment posts 3002A-B such that the first hood body 102 and the second hood body 104 are positioned in a predetermined configuration. The particular location of the alignment posts 3002A-B on the hood bodies 102 and 104, respectively, should not be considered limiting on the current disclosure, as in other examples, the alignment posts 3002A-B may be provided on portions of the hood bodies 102 and 104 that are positioned adjacent to one another in the predetermined configuration. As some non-limiting examples, the alignment posts 3002A-B may be provided on other locations of the hood bodies 102 and 104, on the suction mouth pieces, etc.

In various examples, the alignment pin 123 is removably positioned within the alignment posts 3002A-B to position the first hood body 102 and the second hood body 104 prior to the securing and positioning of the removable securing device 122. In some cases, such positioning may facilitate the positioning and securing of the removable securing device 122. In other examples, the alignment pin 123 is removably positioned within the alignment posts 3002A-B after the removable securing device 122 is positioned and/or secured. In some cases, the dust hood 3000 may optionally be used with the alignment pin 123 and alignment posts 3002A-B and without the removable securing device 122.

In some cases, the removable securing device 122 includes an alignment pin 123 such that the first hood body 102 and the second hood body 104 can be secured together in a predetermined configuration. In various cases, the predetermined configuration includes having the suction mouthpieces 140 and 142 facing the same direction. In other examples, the predetermined configuration may include various other configurations of the components of the dust hood 100 and/or dust hood bodies 102 and 104 relative to one another. In some aspects, the removable securing device 122, first hood body 102, and/or second hood body 104 include apertures that are configured to receive the alignment pin 123. In various aspects, the first hood body 102 and the second hood body 104 are maintained in the particular configuration with the alignment pin 123 prior to positioning of the removable securing device 122 in the secured position, although it need not be in other examples. In some cases, the alignment pin 123 may further selectively maintain the removable securing device 122 in the secured position, although it need not in other examples.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A dust hood comprising: a first hood body; and a second hood body, wherein the first hood body and the second hood body are configured to selectively move between an assembled position and a disassembled position, wherein the first hood body is connected to the second hood body in the assembled position, and wherein the first hood body is detached from the second hood body in the disassembled position.

EC 2. The dust hood of any of the preceding or subsequent example combinations, wherein the first hood body is rotatable about a first axis and wherein the second hood body is rotatable about a second axis.

EC 3. The dust hood of any of the preceding or subsequent example combinations, wherein the first axis is parallel to the second axis.

EC 4. The dust hood of any of the preceding or subsequent example combinations, wherein the first hood body is rotatable independent from the second hood body.

EC 5. The dust hood of any of the preceding or subsequent example combinations, further comprising a securing device configured to removable secure the first hood body with the second hood body.

EC 6. The dust hood of any of the preceding or subsequent example combinations, wherein the securing device comprises a quick opening clamp.

EC 7. The dust hood of any of the preceding or subsequent example combinations, wherein in the assembled position, a chamber of the first hood body is in fluid communication with a chamber of the second hood body.

EC 8. A dust hood comprising: a first hood body; a second hood body; and a securing device configured to selectively secure the first hood body to the second hood body such that a chamber of the first hood body is in fluid communication with a chamber of the second hood body.

EC 9. A method of assembling a dust hood comprising: rotating a first hood body about a first axis; rotating a second hood body about a second axis; and securing the first hood body to the second hood body with a securing device such that a chamber of the first hood body is in fluid communication with a chamber of the second hood body.

EC 10. A dust hood comprising: a first hood body comprising a first end and a second end; and a second hood body comprising a first end and a second end, wherein the first hood body and the second hood body are each movable between assembled position and a disassembled position, wherein, in the assembled position, the second end of the first hood body is positioned adjacent to the second end of the second hood body, and wherein, in the disassembled position, the second end of the first hood body is spaced apart from the second end of the second hood body.

EC 11. The dust hood of the preceding or subsequent example combinations, wherein the first hood body is rotatable about a first axis and wherein the second hood body is rotatable about a second axis.

EC 12. The dust hood of the preceding or subsequent example combinations, wherein the first hood body is rotatable independent from the second hood body.

EC 13. The dust hood of the preceding or subsequent example combinations, wherein, in the assembled position, the first hood body is connected to the second hood body, and wherein, in the disassembled position, the first hood body is detached from the second hood body.

EC 14. The dust hood of the preceding or subsequent example combinations, further comprising a securing device configured to removably secure the first hood body with the second hood body in the assembled position.

EC 15. The dust hood of the preceding or subsequent example combinations, wherein in the assembled position, a chamber of the first hood body is in fluid communication with a chamber of the second hood body.

EC 16. The dust hood of the preceding or subsequent example combinations, further comprising: a first support frame, wherein the first hood body is movably supported on the first support frame such that the first hood body is rotatable about a first axis defined by the first support frame; and a second support frame, wherein the second hood body is movably supported on the second support frame such that the second hood body is rotatable about a second axis defined by the second support frame.

EC 17. The dust hood of the preceding or subsequent example combinations, further comprising: a first support bracket, wherein the first support frame is movably supported on the first support bracket such that the first hood body and the first support frame are rotatable about a third axis defined by the first support bracket; and a second support bracket, wherein the second support frame is movably supported on the second support bracket such that the second hood body and the second support frame are rotatable about a fourth axis defined by the second support bracket.

EC 18. The dust hood of the preceding or subsequent example combinations, wherein the third axis is substantially perpendicular to the first axis, and wherein the fourth axis is substantially perpendicular to the second axis.

EC 19. The dust hood of the preceding or subsequent example combinations, further comprising: a first suction mouthpiece hingedly connected to the first hood body; and a second suction mouthpiece hingedly connected to the second hood body, wherein the first suction mouthpiece is in fluid communication with a chamber of the first hood body such that a material can be pulled through the first suction mouthpiece and into the chamber of the first hood body, and wherein the second suction mouthpiece is in fluid communication with a chamber of the second hood body such that a material can be pulled through the second suction mouthpiece and into the chamber of the second hood body.

EC 20. A dust hood comprising: a first hood body comprising a first chamber, wherein the first hood body is rotatable about a first axis; and a second hood body comprising a second chamber, wherein the second hood body is rotatable about a second axis, wherein, in an assembled configuration, the first chamber is in fluid communication with the second chamber, and wherein, in a disassembled configuration, the first chamber is fluidly disconnected from the second chamber.

EC 21. The dust hood of the preceding or subsequent example combinations, further comprising a securing device configured to selectively secure the first hood body to the second hood body in the assembled configuration.

EC 22. The dust hood of the preceding or subsequent example combinations, wherein the first hood body is rotatable independent from the second hood body.

EC 23. The dust hood of the preceding or subsequent example combinations, further comprising: a first support frame, wherein the first hood body is movably supported on the first support frame such that the first hood body is rotatable about a third axis defined by the first support frame; a second support frame, wherein the second hood body is movably supported on the second support frame such that the second hood body is rotatable about a fourth axis defined by the second support frame; a first support bracket, wherein the first support frame is movably supported on the first support bracket such that the first hood body and the first support frame are rotatable about the first axis; and a second support bracket, wherein the second support frame is movably supported on the second support bracket such that the second hood body and the second support frame are rotatable about the second axis.

EC 24. A dust hood comprising: a first end; a second end opposite from the first end; a first hood body, wherein the first hood body comprises the first end of the dust hood; and a second hood body, wherein the second hood body comprises the second end of the dust hood, and wherein the second hood body is movable relative to the first hood body.

EC 25. The dust hood of the preceding or subsequent example combinations, wherein the first hood body is rotatable about a first axis, and wherein the second hood body is rotatable about a second axis that is substantially parallel to the first axis.

EC 26. The dust hood of the preceding or subsequent example combinations, wherein the first hood body defines a first axis extending along a length of the first hood body, wherein the second hood body defines a second axis extending along a length of the second hood body, and wherein the second hood body is movable relative to the first hood body such that the second axis is selectively positioned between a parallel and non-parallel position relative to the first axis.

EC 27. The dust hood of the preceding or subsequent example combinations, wherein, in an assembled configuration, a chamber of the first hood body is in fluid communication with a chamber of the second hood body.

EC 28. The dust hood of the preceding or subsequent example combinations, wherein, in an assembled configuration, the first hood body is connected to the second hood body through a securing device, and wherein, in a disassembled configuration, the second hood body is detached from the first hood body.

EC 29. The dust hood of the preceding or subsequent example combinations, further comprising: a first suction mouthpiece hingedly connected to the first hood body; and a second suction mouthpiece hingedly connected to the second hood body, wherein the first suction mouthpiece is in fluid communication with a chamber of the first hood body such that a material can be pulled through the first suction mouthpiece and into the chamber of the first hood body, and wherein the second suction mouthpiece is in fluid communication with a chamber of the second hood body such that a material can be pulled through the second suction mouthpiece and into the chamber of the second hood body.

EC 30. A dust hood comprising: a first hood body comprising a first chamber of the dust hood; and a second hood body comprising a second chamber of the dust hood, wherein the first hood body and the second hood body are each selectively movable between an assembled position and a disassembled position, wherein, in the assembled position, the first hood body is adjacent to the second hood body, and wherein, in the disassembled position, the first hood body is spaced apart from the second hood body.

EC 31. A dust hood comprising: a first support comprising a first end of the dust hood; a second support comprising a second end of the dust hood, wherein the second end is opposite from the first end; a first hood body supported on the first support and rotatable about a first axis defined by the first end; and a second hood body supported by the second support and rotatable about a second axis defined by the second end.

EC 32. The dust hood of the preceding or subsequent example combinations, wherein the first hood body is movably supported on the first support such that the first hood body is rotatable about a third axis that is substantially perpendicular to the first axis, and wherein the second hood body is movably supported on the second support such that the second hood body is rotatable about a fourth axis that is substantially perpendicular to the second axis.

The listing of various features should not be considered limiting or exclusive, as various features may be added or removed from the various components. The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A dust hood for a tissue winder, the dust hood comprising:

a first support bracket defining a first end of the dust hood and defining a first axis;

a second support bracket defining a second end of the dust hood opposite the first end of the dust hood and comprising a second axis, wherein the second axis is parallel to the first axis;

a first hood body supported by the first support bracket and comprising a first end proximate to the first support bracket, a second end opposite the first end, and a first chamber of the dust hood, wherein the first hood body is rotatable about the first axis when the dust hood is in a first position; and a second hood body supported by the second support bracket and comprising a first end proximate to the second support bracket, a second end opposite the first end of the second hood body, and a second chamber of the dust hood, wherein the second hood body is rotatable about the second axis when the dust hood is in the first position; and a suction mouthpiece connected to one of the first hood body and the second hood body and in fluid communication with one of the first chamber and the second chamber, wherein the first hood body is rotatably supported by the first support bracket such that the first hood body is movable between the first position and a second position relative to the second hood body while the first hood body is supported by the first support bracket and while the second hood body is supported by the second support bracket, wherein, in the first position, the first hood body is disconnected and spaced apart from the second hood body, and wherein, in the second position the second end of the first hood body is connected to the second end of the second hood body and the first chamber is in fluid communication with the second chamber.

2. The dust hood of claim 1, wherein the first hood body is rotatable about the first axis independent from rotation of the second hood body about the second axis when the first hood body is in the first position.

3. The dust hood of claim 1, further comprising a securing device comprising a clamp configured to secure the first hood body with the second hood body in the second position.

4. The dust hood of claim 1, wherein the suction mouthpiece is a first suction mouthpiece, wherein the first suction mouthpiece is hingedly connected to the first hood body, and wherein the dust hood further comprises:

a second suction mouthpiece hingedly connected to the second hood body, wherein the first suction mouthpiece is in fluid communication with the first chamber of the first hood body, and wherein the second suction mouthpiece is in fluid communication with the second chamber of the second hood body.

5. The dust hood of claim 1, wherein when the dust hood is in the first position, the dust hood further comprises:

a first support frame connecting the first support bracket and the first hood body, wherein the first support frame is hingedly connected to the first support bracket such that the first hood body is rotatable relative to the first support bracket about a third axis; and a second support frame connecting the second support bracket and the second hood body, wherein the second support frame is hingedly connected to the second support bracket such that the second hood body is rotatable relative to the second support bracket about a fourth axis.

6. The dust hood of claim 5, wherein the third axis is perpendicular to the first axis and the fourth axis is perpendicular to the second axis.

7. The dust hood of claim 1, wherein when the dust hood is in the first position; the first hood body is rotatable about the first axis and a third axis relative to the first support bracket, and wherein the third axis is not parallel to the first axis.

8. The dust hood of claim 7, wherein the third axis is perpendicular to the first axis.

9. The dust hood of claim 1, wherein the first hood body is rotatable about a third axis relative to the first support bracket that is perpendicular to the first axis, and wherein the second hood body is rotatable about a fourth axis relative to the second support bracket that is perpendicular to the second axis.

10. The dust hood of claim 9, wherein, when the dust hood is in the second position, the third axis is aligned with the fourth axis, and wherein, when the dust hood is in the first position, the third axis is not aligned with the fourth axis.

11. The dust hood of claim 9, wherein, when the dust hood is in the second position, the third axis is aligned with the fourth axis, and the first hood body and second hood body are jointly rotatable about the aligned third axis and fourth axis.

12. A dust hood for a tissue winder, the dust hood comprising:

a first support bracket;

a second support bracket;

a first hood body rotatably supported by the first support bracket and comprising a first end, a second end opposite the first end, and a first chamber of the dust hood, wherein the first end is closed and the second end defines an aperture, wherein when the first hood body is in a first position, the first hood body is rotatable about a first axis and a second axis relative to the first support bracket, wherein the first axis is perpendicular to the second axis; and a second hood body rotatably supported by the second support bracket and comprising a first end, a second end opposite the first end of the second hood body, and a second chamber of the dust hood, wherein the first end of the second hood body is closed and the second end of the second hood body defines an aperture; and a suction mouthpiece attached to one of the first hood body and the second hood body and in fluid communication with one of the first chamber and the second chamber, wherein the first hood body and the second hood body are configurable between the first position and a second position while supported by the first support bracket and the second support bracket, wherein, in the first position, the second end of the first hood body is disconnected from and spaced apart from the second end of the second hood body, and wherein, in the second position, the second end of the first hood body is connected to and the first hood body and the second hood body are between the first support bracket and the second support bracket the second end of the second hood body.

13. The dust hood of claim 12, wherein, in the second position, the first hood body is rotatable about the second axis and the second hood body is rotatable with the first hood body.

14. The dust hood of claim 12, wherein when the dust hood is in the first position, the second hood body is rotatable about a third axis and a fourth axis relative to the second support bracket, and wherein the third axis is perpendicular to the fourth axis.

15. The dust hood of claim 14, wherein the third axis is parallel to the first axis, and wherein, in the second position, the fourth axis is aligned with the second axis, and wherein, in the first position, the fourth axis is not aligned with the second axis.

16. A dust hood for a tissue winder, the dust hood comprising:

a first support bracket defining a first end of the dust hood;

a second support bracket defining a second end of the dust hood opposite the first end;

a first hood body supported by the first support bracket and comprising a first end proximate to the first support bracket, a second end opposite the first end, and a first chamber of the dust hood, wherein when the first hood body is in a first position, the first hood body is rotatable about a first axis and a second axis relative to the first support bracket, wherein the first axis is perpendicular to the second axis; and a second hood body supported by the second support bracket and comprising a first end proximate to the second support bracket, a second end opposite the first end of the second hood body, and a second chamber of the dust hood; and a suction mouthpiece connected to one of the first hood body and the second hood body and in fluid communication with one of the first chamber and the second chamber, wherein in the first position the first hood body is rotatably supported by the first support bracket such that the first hood body is movable between the first position and a second position relative to the second hood body while the first hood body is supported by the first support bracket and while the second hood body is supported by the second support bracket, wherein, in the first position, the second end of the first hood body is spaced apart and disconnected from the second end of the second hood body and the second end of the first hood body and the second end of the second hood body are between the first support bracket and the second support bracket, and wherein, in the second position, the second end of the first hood body is connected to the second end of the second hood body by a distance greater than a distance between the second end of the first hood body and the second end of the second hood body in the first position.

17. The dust hood of claim 16, wherein when the second hood body is in the first position, the second hood body is rotatable about a third axis and a fourth axis relative to the second support bracket, and wherein the third axis is perpendicular to the fourth axis.

18. The dust hood of claim 17, wherein the third axis is parallel to the first axis, and wherein, in the second position, the fourth axis is aligned with the second axis, and wherein, in the first position, the fourth axis is not aligned with the second axis.

* * * * *